US008036543B2

(12) United States Patent
Yokomori et al.

(10) Patent No.: US 8,036,543 B2
(45) Date of Patent: Oct. 11, 2011

(54) DEVELOPING APPARATUS, PROCESS CARTRIDGE AND IMAGE FORMING APPARATUS

(75) Inventors: Kanji Yokomori, Odawara (JP); Yuuki Nakamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 387 days.

(21) Appl. No.: 11/941,495

(22) Filed: Nov. 16, 2007

(65) Prior Publication Data

US 2008/0292331 A1 Nov. 27, 2008

(30) Foreign Application Priority Data

Jan. 31, 2007 (JP) ..... 2007-022466
Nov. 8, 2007 (JP) ..... 2007-291356

(51) Int. Cl.
*G03G 15/08* (2006.01)

(52) U.S. Cl. ..... 399/27; 399/119; 399/254

(58) Field of Classification Search ..... 399/24, 399/25, 27, 107, 111, 119, 120, 222, 252, 399/254, 255, 256, 258, 262, 263
See application file for complete search history.

(56) References Cited

U.S. PATENT DOCUMENTS

| | | | | |
|---|---|---|---|---|
| 5,649,264 | A | 7/1997 | Domon et al. | 399/30 |
| 5,839,028 | A | 11/1998 | Nomura et al. | 399/109 |
| 5,878,309 | A | 3/1999 | Nomura et al. | 399/111 |
| 5,913,097 | A | 6/1999 | Nakano et al. | 399/256 |
| 5,940,657 | A | 8/1999 | Yokomori et al. | 399/119 |
| 5,943,528 | A | 8/1999 | Akutsu et al. | 399/110 |
| 5,950,049 | A | 9/1999 | Yokomori et al. | 399/119 |
| 5,953,562 | A | 9/1999 | Kawaguchi et al. | 399/117 |
| 6,029,031 | A | 2/2000 | Yokomori et al. | 399/109 |
| 6,055,406 | A | 4/2000 | Kawai et al. | 399/360 |
| 6,064,843 | A | 5/2000 | Isobe et al. | 399/111 |
| 6,072,969 | A | 6/2000 | Yokomori et al. | 399/119 |
| 6,215,969 | B1 | 4/2001 | Nomura et al. | 399/111 |
| 6,345,164 | B1 | 2/2002 | Yokomori et al. | 399/119 |
| 6,381,430 | B1 | 4/2002 | Yokomori et al. | 399/119 |
| 6,459,869 | B2 | 10/2002 | Nittani et al. | 399/111 |
| 6,463,232 | B1 | 10/2002 | Kawai et al. | 399/111 |

(Continued)

FOREIGN PATENT DOCUMENTS

EP 1 318 434 6/2003

(Continued)

OTHER PUBLICATIONS

European Search Report dated May 6, 2008 in European Application No. 07122811.8-1240.

(Continued)

*Primary Examiner* — David Porta
*Assistant Examiner* — Benjamin Schmitt
(74) *Attorney, Agent, or Firm* — Fitzpatrick, Cella, Harper & Scinto

(57) ABSTRACT

A developing apparatus usable with an electrophotographic image forming apparatus, the apparatus including a developer accommodating container, a developer chamber including a developer carrying member carrying and feeding a developer supplied from the container to develop an electrostatic latent image formed on an electrophotographic photosensitive member, a stirrer stirring the developer in the chamber and supplying the developer from the container into the chamber through an opening in the container, a wall surface, provided in the container, for being contacted by a free end portion of the stirrer while the stirrer moves, and a detector detecting a remaining amount of the developer. The position where the free end portion of the stirrer separates from the wall surface is above the detector and inside the container.

16 Claims, 23 Drawing Sheets

U.S. PATENT DOCUMENTS

| | | | | |
|---|---|---|---|---|
| 6,463,234 | B2 | 10/2002 | Arimitsu et al. | 399/113 |
| 6,480,687 | B1 | 11/2002 | Kawai et al. | 399/111 |
| 6,684,041 | B2 | 1/2004 | Yokomori et al. | 399/167 |
| 6,738,588 | B2 | 5/2004 | Yokomori et al. | 399/111 |
| 6,834,171 | B2 | 12/2004 | Nittani et al. | 399/103 |
| 6,934,489 | B2 | 8/2005 | Yokomori et al. | 399/111 |
| 6,980,758 | B2 | 12/2005 | Murayama et al. | 399/111 |
| 7,016,626 | B2 | 3/2006 | Yokomori et al. | 399/117 |
| 7,024,137 | B2 | 4/2006 | Nittani et al. | 399/222 |
| 7,039,339 | B2 | 5/2006 | Yokomori et al. | 399/111 |
| 7,072,603 | B2 | 7/2006 | Tsuzuki et al. | 399/111 |
| 7,158,735 | B2 | 1/2007 | Murayama et al. | 399/111 |
| 7,162,181 | B2 | 1/2007 | Maeshima et al. | 399/109 |
| 7,215,909 | B2 | 5/2007 | Nittani et al. | 399/222 |
| 7,272,339 | B2 | 9/2007 | Tsuzuki et al. | 399/111 |
| 7,340,197 | B2 | 3/2008 | Murayama et al. | 399/111 |
| 2006/0233560 | A1 | 10/2006 | Harada et al. | 399/27 |

FOREIGN PATENT DOCUMENTS

| | | |
|---|---|---|
| EP | 1 324 156 | 7/2003 |
| EP | 1 477 868 | 11/2004 |
| JP | 2003-131479 | 5/2003 |

OTHER PUBLICATIONS

Russian Office Action dated Jul. 20, 2009, issued in Russian Application No. 2008103643/28(003957), and English-language translation thereof.

Chinese Office Action dated Sep. 25, 2009, issued in Chinese Application No. 200810004965.2, and English-language translation thereof.

Korean Office Action dated Aug. 3, 2009, in counterpart Korean Application No. 10-2008-0010239, and English-language translation.

Russian Office Action issued in Russian Application No. 2008103643/28(003957) dated Mar. 16, 2009, and an English-language translation thereof.

DEVELOPING APPARATUS, PROCESS CARTRIDGE AND IMAGE FORMING APPARATUS

FIELD OF THE INVENTION AND RELATED ART

The present invention relates to an electrophotographic image forming apparatus, a developing apparatus employed by an electrophotographic image forming apparatus, and a process cartridge removably mountable in an electrophotographic image forming apparatus.

Here, the phrase "electrophotographic image forming apparatus" refers to an apparatus which forms an image on a recording medium, using an electrophotographic image forming method. Examples of an electrophotographic image forming apparatus include an electrophotographic copying machine, an electrophotographic printer (a laser beam printer, an LED printer, etc.), a facsimile apparatus, a word processor, and a multifunction apparatus capable of performing two or more functions of the preceding apparatuses, etc.

A "developing apparatus" is an apparatus which develops an electrostatic latent image on an image bearing member, such as an electrophotographic photosensitive drum, into a visible image, with the use of developer.

The process cartridge is a cartridge in which at least a developing means and an electrophotographic photosensitive drum, are integrally disposed so that they can be removably mountable in the main assembly of an electrophotographic image forming apparatus.

As has been known, an image forming apparatus, such as a copying machine, a printer, or a facsimile machine, forms an electrostatic latent image on an image bearing member, such as an electrophotographic photosensitive member, and develops the electrostatic latent image into a visible image, more specifically, a visible image formed of toner, with the use of a developing apparatus.

In the past, in the field of an image forming apparatus employing an electrophotographic image formation process, a process cartridge system has long been in use, according to which an electrophotographic photosensitive member, and one or more process cartridges which act on the electrophotographic photosensitive member, are integrally disposed in a cartridge removably mountable in the main assembly of an image forming apparatus. A process cartridge system makes it possible for a user to maintain an electrophotographic image forming apparatus without relying on a service person. Therefore, it can drastically improve an electrophotographic image forming apparatus, in terms of operability.

One of the primary reasons for process cartridge replacement is developer (toner) depletion. Thus, in order to prompt a user of timely process cartridge replacement by giving in advance the user the information regarding the amount of toner remainder, some of the recent electrophotographic image forming apparatuses are designed so that they detect the amount of the toner remaining in a process cartridge. There are various methods usable for detecting the amount of remaining toner.

One of the methods for detecting the amount of the remaining toner is recorded in Japanese Laid-open Patent Application 2003-131479 (FIG. 5), according to which the amount of the remaining toner is detected based on the amount of light transmission. Here, the general concept of detecting the amount of the remaining toner based on the amount of light transmission will be described with reference to a developing apparatus 104 shown in FIG. 13.

A beam of light for detecting the amount of the remaining toner (which hereafter may be referred to simply as detection light), which is emitted from a light emitting portion, such as an LED, attached to the main assembly of an image forming apparatus, is guided through a light guide (unshown) attached to the image forming apparatus or the toner container 141 of a process cartridge, and then, into the toner container 141 through a transparent window 173 of the toner container 141.

The toner container 141 is structured so that as the detection light L enters the toner container 141, it comes out, or fails to come out, of the toner container 141 through another transparent window or the like. Various factors determine whether the detection beam comes out of the toner container 141, such as the amount of toner in the toner container. As the detection light L comes out of the light exit window, it is guided to a light receiving portion (unshown), such as a phototransistor, by a light guide (unshown), such as the abovementioned light guide, attached to the main assembly of the image forming apparatus, or the toner container 141. The light receiving portion is attached to the main assembly of the image forming apparatus, or the like.

Generally, there are a pair of rotational stirring members 171 and 172 in the toner container 141. The stirring members 171 and 172 are for conveying the toner in the toner container toward a development roller 140 while stirring the toner. As the detection light L enters the toner container 141 while the stirring member 171 and 172 are rotated, it is blocked by the stirring members 171 and 172 and/or the toner. The smaller the amount of toner in the toner container 141, the longer the length of time the detection light L is transmitted through the toner container 141. Thus, the amount of toner (toner remainder) in the toner container 141 can be estimated by measuring the length of time the detection light L is transmitted through the toner container 141. This method of detecting (estimating) the amount of the remaining toner in the toner container 141 is referred to as a remaining toner amount detecting method of the light transmission type.

The present invention is a further development of the prior art described above.

In the case of the prior art described above, as the stirring members 171 and 172 in the toner container 141 are rotated, the toner that has adhered to the transparent windows 173 and 174 is removed by the stirring members 171 and 172, thereby allowing transmission of the detection light L through the toner container 141 until the toner again covers the transparent windows 173 and 174 by returning to, and accumulating on, the windows 173 and 174. If the amount of light received by the light receiving portion, which is provided with the main assembly of the image forming apparatus, is expressed in the form of a graph, the vertical and horizontal axes of which represent the amount of light received and the length of elapsed time, respectively, as the amount of light received by the light receiving portion changes, as shown in FIG. 23, a waveform, as shown in FIG. 23, is obtained. As the control portion of the main assembly of the image forming apparatus receives, from the light receiving portion, the electric signals which correspond to the amount of light received by the light receiving portion, it measures the length of the periods a1, a2, a3, . . . of time, in which the amount of the received light is no less than a preset value (threshold value). Then, based on the measured length of the periods of time, the control portion calculates (estimates) the amount of the remaining toner in the toner container 141.

However, the pattern of the changes in the amount of light received by the light receiving portion, which is expressed by the waveform in FIG. 23, is affected by the shape of the toner container 141, the positional relationship between the transparent windows 173 and 174 and stirring members 171 and 172, etc. Therefore, the amount of light which the light receiving portion receives does not always change in the same pattern (waveform). Thus, if the threshold value is set as shown in FIG. 23, the periods a1, a2, a3, . . . become different in length, thereby affecting the accuracy with which the amount of the remaining toner in the toner container 141 can be detected.

SUMMARY OF THE INVENTION

The present invention is made in consideration of the problem described above. Thus, the primary object of the present invention is to provide a developing apparatus, a process cartridge, and an electrophotographic image forming apparatus, in which the amount of the remaining developer can be precisely detected.

According to an aspect of the present invention, there is provided a developing apparatus for use with an electrophotographic image forming apparatus, the developing device comprising a developer accommodating chamber for accommodating a developer; a developer chamber including a developer carrying member for carrying and feeding a developer supplied from the developer accommodating chamber to develop an electrostatic latent image formed on an electrophotographic photosensitive member; a developer stirring member, rotatably provided in the developer accommodating chamber, for stirring the developer in the developer chamber, and then supplying the developer from the developer accommodating chamber into the developer chamber through an opening formed in an upper part of the developer accommodating chamber; a wall surface, provided in the developer accommodating chamber, for being contacted by a free end portion of the developer stirring member while the developer stirring member is moving, wherein the developer stirring member lifts the developer toward the opening along the wall surface in the developer accommodating chamber; a developer detecting member, provided at the wall surface, for detecting a remaining amount of the developer by transmitting detecting light into the developer accommodating chamber; wherein a position where the free end portion of the developer stirring member separates from the wall surface is above the developer detecting member and inside the developer accommodating chamber.

According to another aspect of the present invention, there is provided a process cartridge detachably mountable to a main assembly of an electrophotographic image forming apparatus, the process cartridge comprising an electrophotographic photosensitive member on which an electrostatic latent image is formed; a developer accommodating chamber for accommodating a developer; a developer chamber including a developer carrying member for carrying and feeding a developer supplied from the developer accommodating chamber to develop the electrostatic latent image formed on an electrophotographic photosensitive member; a developer stirring member, rotatably provided in the developer accommodating chamber, for stirring the developer in the developer chamber, and then supplying the developer from the developer accommodating chamber into the developer chamber through an opening formed in an upper part of the developer accommodating chamber, when the process cartridge is mounted to the main assembly of the electrophotographic image forming apparatus; a wall surface, provided in the developer accommodating chamber, for being contacted by a free end portion of the developer stirring member while the developer stirring member is moving, wherein the developer stirring member lifts the developer toward the opening along the wall surface in the developer accommodating chamber; a developer detecting member, provided at the wall surface, for detecting a remaining amount of the developer by transmitting detecting light into the developer accommodating chamber; wherein a position where the free end portion of the developer stirring member separates from the wall surface is above the developer detecting member and inside the developer accommodating chamber.

According to a further aspect of the present invention, there is provided an electrophotographic image forming apparatus for forming an image on a recording material, the apparatus comprising:

(i) a developing device including, a developer accommodating chamber for accommodating a developer, a developer chamber including a developer carrying member for carrying and feeding a developer supplied from the developer accommodating chamber to develop an electrostatic latent image formed on an electrophotographic photosensitive member, a developer stirring member, rotatably provided in the developer accommodating chamber, for stirring the developer in the developer chamber, and then supplying the developer from the developer accommodating chamber into the developer chamber through an opening formed in an upper part of the developer accommodating chamber; a wall surface, provided in the developer accommodating chamber, for being contacted by a free end portion of the developer stirring member while the developer stirring member is moving, wherein the developer stirring member lifts the developer toward the opening along the wall surface in the developer accommodating chamber, a developer detecting member, provided at the wall surface, for detecting a remaining amount of the developer by transmitting detecting light into the developer accommodating chamber, wherein a position where the free end portion of the developer stirring member separates from the wall surface is above the developer detecting member and inside the developer accommodating chamber; and (ii) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the developing apparatus, process cartridge, and electrophotographic image forming apparatus, which are in accordance with the present invention will be described in more detail with reference to the appended drawings.

Embodiment 1

Figure 1:
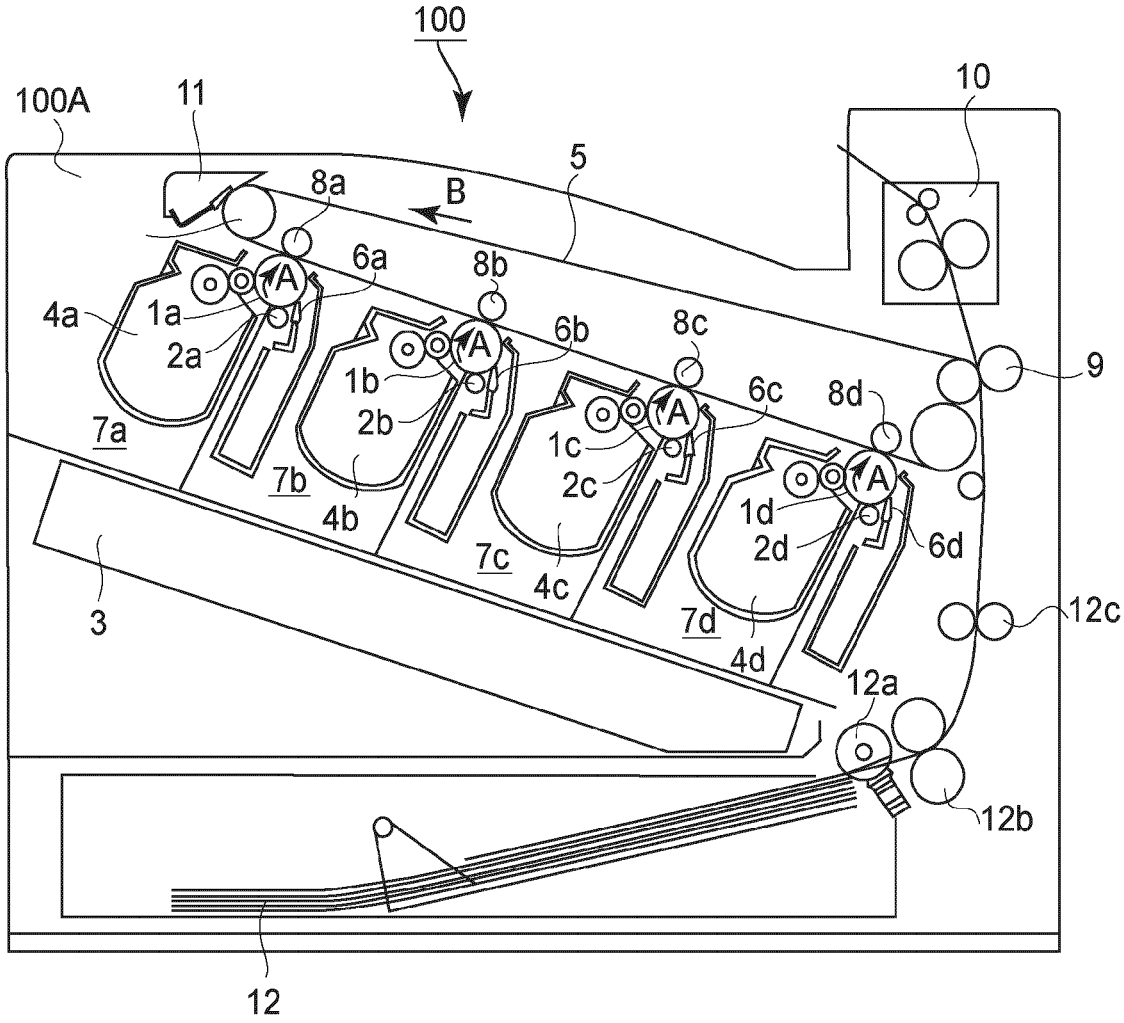
FIG. 1 is a schematic sectional view of the image forming apparatus in the first embodiment of the present invention, showing the general structure of the apparatus.

FIG. 1 is a schematic sectional view of the electrophotographic image forming apparatus in the first of the preferred embodiments of the present invention, and shows the general structure of the apparatus. The electrophotographic image forming apparatus shown in FIG. 1 is an electrophotographic color image forming apparatus. However, the application of the present invention is not limited to an electrophotographic color image forming apparatus, such as the one shown in FIG. 1. That is, the present invention is also applicable to an electrophotographic monochromatic image forming apparatus, and various electrophotographic image forming apparatuses other than the apparatus shown in FIG. 1.

First, the general structure of the electrophotographic color image forming apparatus in this embodiment will be described regarding its general structure.

[Image Forming Apparatus]

Referring to FIG. 1, the electrophotographic color image forming apparatus 100 in this embodiment has four image bearing members, more specifically, four electrophotographic photosensitive members 1 (1*a*-1*d*), which are in the form of a drum (which hereafter will be referred to as "photosensitive drums 1"). The multiple image bearing members are arranged side by side (juxtaposed) in parallel in a horizontal straight row. The photosensitive drum 1 is rotationally driven in the direction indicated by an arrow mark A in the drawing, by an unshown driving means. The image forming apparatus 100 is also provided with various processing means, which are in the adjacencies of the peripheral surface of the photosensitive drum 1 and are arranged in the rotational direction of the photosensitive drum 1.

More specifically, disposed in the adjacencies of the peripheral surface of each photosensitive drum 1 are a charging means 2 (2*a*-2*d*), such as a charge roller, for uniformly charging the peripheral surface of the photosensitive drum 1, and a scanner unit 3 for forming an electrostatic latent image on the peripheral surface of the photosensitive drum 1, by projecting a beam of laser light, while modulating the beam with pictorial information. Also disposed in the adjacencies of the peripheral surface of the photosensitive drum 1 are a development unit 4 (4*a*-4*d*) and an intermediary transfer belt 5. The development unit 4 is a developing apparatus, which develops an electrostatic latent image on the peripheral surface of the photosensitive drum 1 into a visible image, that is, an image formed of toner. The intermediary transfer belt 5 is a belt for transferring the toner image on the photosensitive drum 1, onto a sheet 12 of recording paper as the recording medium. There is also a cleaning member 6 (6*a*-6*d*) in the adjacencies of the peripheral surface of the photosensitive drum 1. The cleaning member 6 is for removing the toner (transfer residual toner) remaining on the peripheral surface of the photosensitive drum 1 after the toner image transfer from the photosensitive drum 1.

In this embodiment, the photosensitive drum 1, and the processing means, more specifically, the charging means 2, the development unit 4, and the cleaning member 6, which process the photosensitive drum 1, are integrally disposed in a cartridge (process cartridge 7 (7*a*-7*d*)), which is removably mountable in the main assembly 100A of the electrophotographic image forming apparatus.

In this embodiment, the process cartridges 7 (7*a*-7*d*) are the same in shape, and store yellow, magenta, cyan, and black developers (which hereafter will be referred to as toner), respectively, which are nonmagnetic single component developers.

The intermediary transfer belt 5, which is an intermediary transferring apparatus, is located above the process cartridge bays of the main assembly 100A of the electrophotographic image forming apparatus, into which the process cartridges 7 (7*a*-7*d*) are mounted. The intermediary transfer belt 5 is in contact with the photosensitive drum 1 (1*a*-1*d*) of each process cartridge 7 (7*a*-7*d*), and rotates (circularly moves) in the direction indicated by an arrow mark B.

On the inward side of the loop which the intermediary transfer belt 5 forms, four primary transfer rollers 8 (8*a*-8*d*), as primary transferring means, are arranged in parallel so that they oppose the four photosensitive drums 1, one for one. To the primary transfer roller 8, a bias, which is opposite in polarity to the normal polarity to which the toner is charged, is applied from an unshown high voltage power source. As the primary transfer bias is applied to the primary transfer roller 8, the toner image on the photosensitive drum 1 is transferred (primary transfer) onto the intermediary transfer belt 5.

Meanwhile a recording medium 12 is conveyed, in synchronism with the movement of the intermediary transfer belt 5, by a sheet conveying means, such as a sheet feeder roller 12*a*, sheet conveyance roller 12*b* and 12*c*, etc., to the secondary transfer portion, which has a secondary transfer roller 9 as a secondary transferring means. In the secondary transfer portion, the secondary transfer roller 9 remains pressed upon the intermediary transfer belt 5 with the presence of the recording paper 12 between the secondary transfer roller 9 and intermediary transfer belt 5. The secondary transfer roller 9 has the same structure as the primary transfer roller 8. To the secondary transfer roller 9, bias, which is opposite in polarity to the normal polarity to which the toner is charged, is applied from an unshown high voltage power source. As the bias is applied to the secondary transfer roller 9, the four toner images, different in color, on the intermediary transfer belt 5 are transferred together (secondary transfer) onto the recording paper 12.

After the transfer of the four toner images, different in color, onto the recording paper 12, the recording paper 12 is conveyed to the fixing apparatus 10. In the fixing apparatus 10, the toner images are fixed to the recording medium 12 by the application of heat and pressure. The residual toner remaining on the intermediary transfer belt 5 after the secondary transfer is removed by a cleaning apparatus 11, which is an apparatus for cleaning the intermediary transfer belt 5.

[Process Cartridge]

Figure 2:
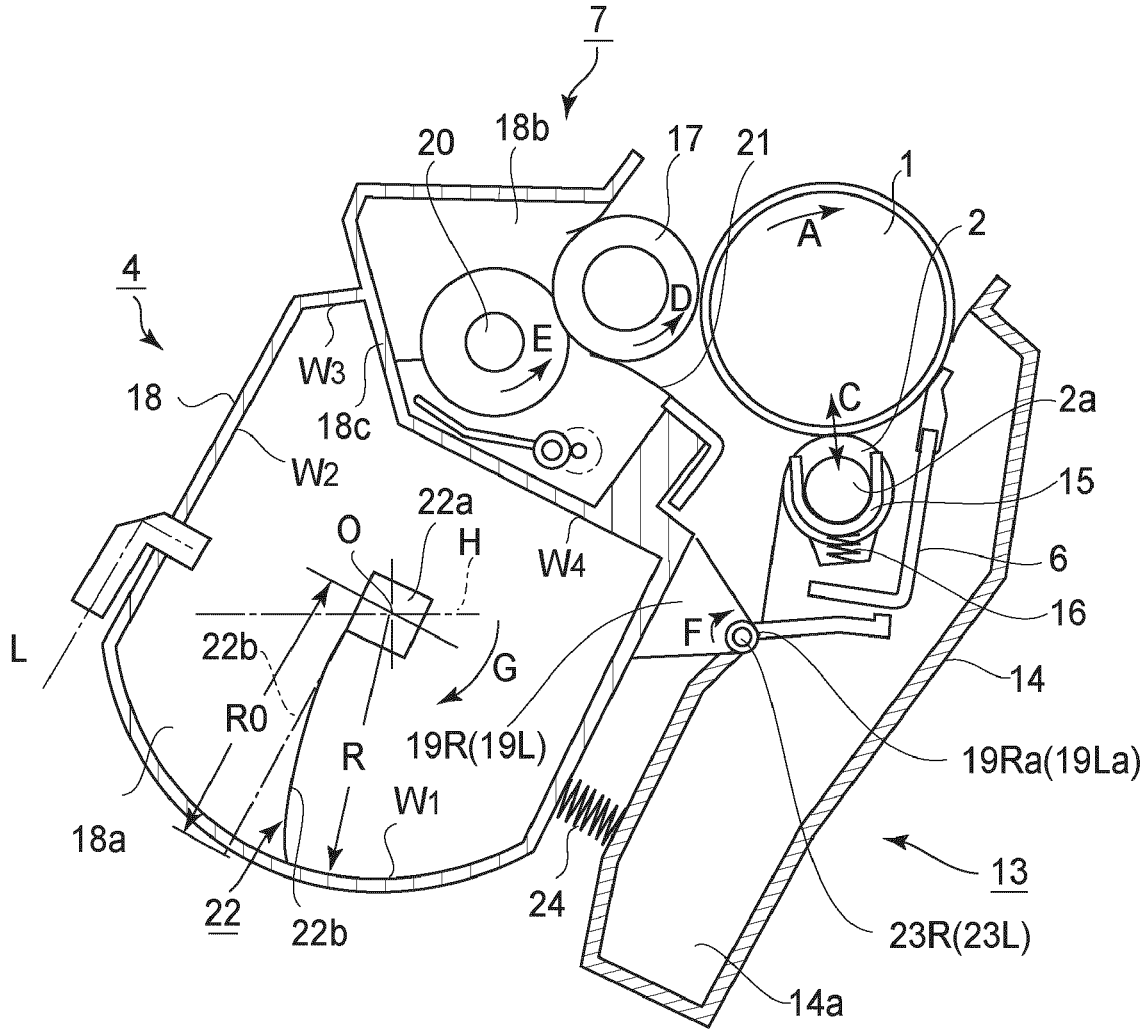
FIG. 2 is a cross-sectional view of the process cartridge in the first embodiment of the present invention, showing the general structure of the cartridge.

Next, referring to FIG. 2, the process cartridge 7 (7*a*-7*d*) will be described regarding its general structure. FIG. 2 is a schematic cross-sectional view of the process cartridge 7 which is in its image forming position in the main assembly 100A of the electrophotographic image forming apparatus.

In this embodiment, a cartridge 7*a*, which contains yellow toner, a cartridge 7*b*, which contains magenta toner, a cartridge 7*c*, which contains cyan toner, and a cartridge 7*d*, which contains black toner, are the same in structure.

The process cartridge 7 has a photosensitive member unit 13 made up of the photosensitive drum 1, etc., and the development unit 4 made up of the development roller 17, as a developer bearing member, etc. Next, each unit will be described.

To the cleaning means frame 14 of the photosensitive member unit 13, the photosensitive drum 1 is rotatably attached with interposition of a pair of unshown bearings. In the adjacencies of the peripheral surface of the photosensitive drum 1, the charge roller 2, and cleaning member 6 are disposed. As the residual toner is removed from the peripheral surface of the photosensitive drum 1 by the cleaning member 6, it falls into a toner chamber 14*a* for the removed residual toner.

As the driving force from a driving motor (unshown) is transmitted to the photosensitive member unit 13, the photosensitive drum 1 is rotationally driven in synchronism with the progression of the image forming operation. To the cleaning means frame 14, a pair of charge roller bearings 15 are attached so that the bearings 15 are movable in the direction indicated by a double-headed arrow mark C, the theoretical extension of which coincides with the axial lines of the charge roller 2 and the photosensitive drum 1. The shaft 2*a* of the charge roller 2 is rotatably borne by the pair of charge roller bearings 15, which are kept pressured toward the photosensitive drum 1 by a pair of compression springs 16.

The developing means frame 18 of the development unit 4 has a developer storage chamber 18*a* (which hereafter may be referred to as the toner storage chamber) and a development chamber 18*b*. The toner storage chamber 18*a* stores toner. There is a development roller 17, as a developer bearing member, in the development chamber 18*b*. The development roller 17 rotates in contact with the photosensitive drum 1, in the direction indicated by an arrow mark D.

In this embodiment, the development chamber 18*b* is above the developer storage chamber 18*a*. The developer storage chamber 18*a* and the development chamber 18*b* are connected with each other, through a hole 18*c*, which is provided with the partition wall between the two chambers 18*b* and 18*a*.

The development roller 17 in the development chamber 18*b* is rotatably supported by a developing means frame 18. More specifically, the development roller 17 is supported at its lengthwise end portions by a pair of bearing members (unshown) attached to the lengthwise ends of the developing means frame 18. The development unit 4 is also provided with a developer supply roller 20 (which hereafter will be referred to as the toner supply roller) and a development blade 21, which are in the adjacencies of the peripheral surface of the development roller 17. The toner supply roller 20 rotates in contact with the development roller 17 in the direction indicated by an arrow mark E. The development blade 21 is for regulating the thickness of the toner layer on the peripheral surface of the development roller 17.

Further, the development unit 4 has a developer stirring member 22 (which hereafter will be referred to as the toner stirring member) for stirring the toner in the toner storage chamber 18*a* while conveying the toner to the abovementioned toner supply roller 20. The toner stirring member 22 is rotatably supported in the toner storage chamber 18*a*.

Referring to FIG. 2, the wall of the toner storage chamber 18*a* has a bottom portion W1, a first portion W2, a second portion W3, and a third portion W4. The bottom portion W1 is the portion which is at the bottom when the cartridge is in its image forming position, that is, when the position of the cartridge is as shown in FIG. 2. In terms of the rotational direction G of the toner stiffing member 22, the first portion W2 is on the downstream side of the bottom portion W1. It is connected with the bottom portion W1, and is tilted toward the axial line of the toner stirring member 22, relative to the vertical direction. The second portion W3 is on the downstream side of the first portion W2, and extends from the first portion W2 to the hole 18*c*. The third portion W4 is on the downstream side of the hole 18*c*, and extends from the hole 18*c* to the bottom portion W1.

While the toner stirring member 22 rotates in the toner storage chamber 18*a* across the portion of its sweeping areas, which correspond to the bottom portion W1 and first portion W2 of the wall of the toner storage chamber 18*a*, the sweeping edge portion of the toner stiffing member 22 moves in contact with the bottom portion W1 and first portion W2, respectively, of the toner storage chamber wall, as will be described later in detail. Thus, as the toner stirring member 22 rotates, the body of toner T in the toner storage chamber 18*a* is upwardly conveyed from the area corresponding to the bottom portion W1 to the area corresponding to the first portion W2, and then, is guided to the hole 18*c* along the second portion W3.

The portion of the body of toner T, which failed to be guided into the hole 18*c*, falls down, or is guided inward of the toner storage chamber 18*a* along the third portion W4.

The development unit 4 is pivotally connected to the photosensitive member unit 13. More specifically, the lateral plates 19R and 19L of the development unit 4 are provided with holes 19Ra and 19La, respectively. Further, a pair of connective pins 23R and 23L are put through the holes 19Ra and 19La and the corresponding holes of the photosensitive member unit 13 so that the development unit 4 is pivotally movable relative to the photosensitive member unit 13. As described above, the development unit 4 is under the pressure from compression springs 24 for pressing the development unit 4. Therefore, when the process cartridge 7 is being used for image formation, and therefore, as an image forming operation begins, the process cartridge 7 is pivoted about the connective pins 23 in the direction indicated by an arrow mark F, whereby the development roller 17 is placed in contact with the photosensitive drum 1.

[Structure Arrangement for Detecting Amount of Toner Remainder]

Next, referring to FIGS. 2-5, the detection of the amount of the developer remaining in the toner storage chamber 18*a* (which hereafter may be referred to simply as the toner remainder detection), in this embodiment, will be described.

Referring to FIG. 2, the toner stiffing member 22 is in the toner storage chamber 18*a* which stores toner. It conveys toner to the toner supply roller 20 by being rotated in the direction G.

Figure 3:
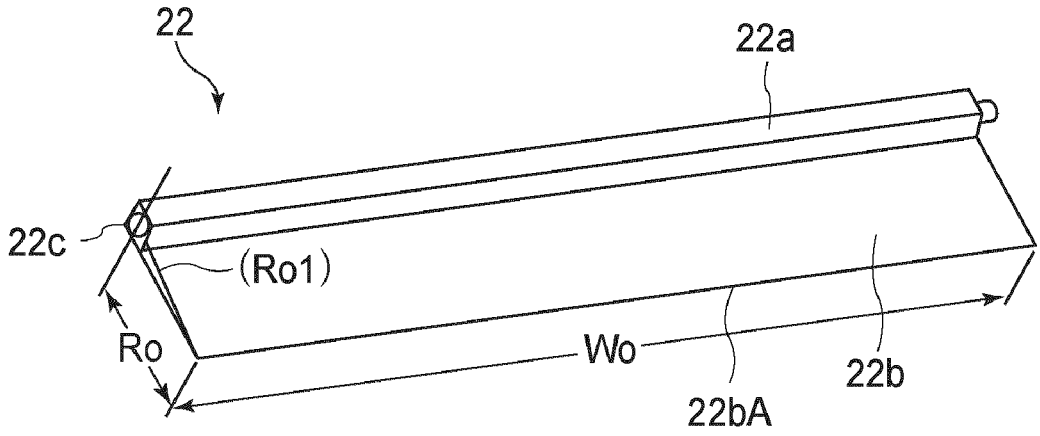
FIG. 3 is a schematic perspective view of the toner stirring member.
Figure 4:
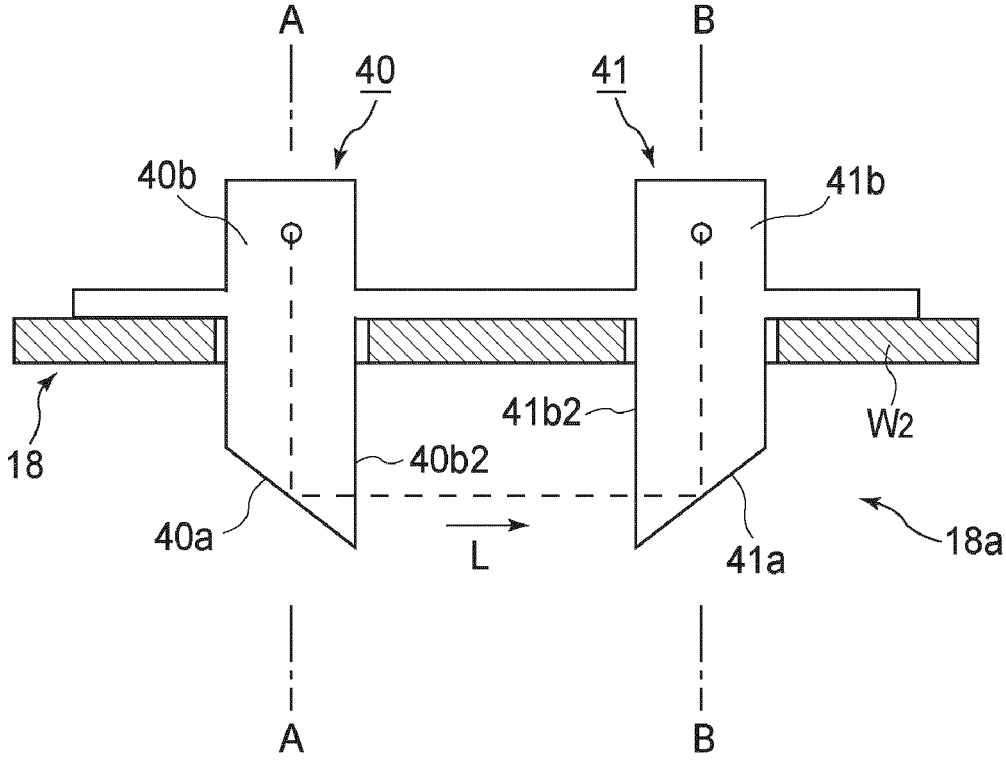
FIG. 4 is a top view of the transparent member.

Referring to FIG. 3, the toner stiffing member 22 is made up of a shaft 22*a* and a stiffing sheet 22*b*. The shaft 22*a* is molded of a resinous substance. The stirring sheet 22*b* is attached to the shaft 22*a* by one of the longer edges. The stiffing sheet 22*b* is the very portion of the toner stiffing member 22 that stirs toner. It can be easily made of a flexible resinous sheet, such as polyester film, polyphenylene sulfide film, or the like. The thickness of the stirring sheet 22*b* is desired to be in a range of 50-250 μm.

In order to ensure that the stirring member 22 stirs and conveys even the toner in the bottom portion of the toner storage chamber 18*a*, the length RO of the shorter edges of the stirring sheet 22*b* is made greater than the distances from the rotational axis O of the stirring member 22 to the internal wall of the toner storage chamber 18*a*, in particular, the internal surfaces of the portions W1, W2, and W3 of the toner storage chamber wall. The length W0 of the longer edges of the stirring sheet 22*b* is made to be the same as the distance between the internal surfaces of the lateral walls (end walls in terms of the rotational axis of stirring member 22) of the toner storage chamber 18*a*.

The force for driving the stirring member 22 is transmitted to the stirring member 22 by a driver gear (unshown) attached to one of the lengthwise ends of the shaft 22*a*; the shaft of the driver gear is inserted in the hole 22*c*, which is provided with one of the lengthwise ends of the shaft 22*a*, through a hole which is provided with the lateral wall of the toner storage chamber 18*a* of the developing means frame 18.

Further, the toner storage chamber 18*a* is provided with a remaining toner amount detecting means of the light transmission type, which is for detecting the amount of the toner remaining in the toner storage chamber 18*a*. More specifically, referring to FIGS. 4, 5(*a*), and 5(*b*), in this embodiment, the development unit 4 is provided with a pair of transparent members 40 and 41, of which the remaining toner amount detecting means (developer amount detecting means) is made. The transparent members 40 and 41 are attached to the first portion W2 of the wall of the toner storage chamber 18*a* of the developing means frame 18, as will be described later. The transparent members 40 and 41 are aligned in the direction parallel to the lengthwise direction of the development roller 17. It is preferred that the transparent members 40 and 41 are positioned above the horizontal plane which coincides with the rotational axis of the toner stirring member 22.

The transparent member 40 has a light exit portion 40*a*, through which the detection light L exits from the transparent member 40, whereas the transparent member 41 has a light entrance portion 41*a*, through which the detection light L enters the transparent member 41.

The transparent member 40 has the light exit portion 40*a* and a light guide portion 40*b*. The light guide portion 40*b* guides the detection light L emitted from an LED (unshown), as a light emitting portion, with which the main assembly 100A of the electrophotographic image forming apparatus is provided. The light exit portion 40*a* and light guide portion 40*b* are integral portions of the transparent member 40.

The transparent member 41 has the light entrance portion 41*a* and a light guide portion 41*b*. The light guide portion 41*a* guides the detection light L to a phototransistor (unshown), as a light receiving portion, with which the main assembly 100*a* of the electrophotographic image forming apparatus is provided, after the detection light L transmits through the toner storage chamber 18*a*.

Figure 5:
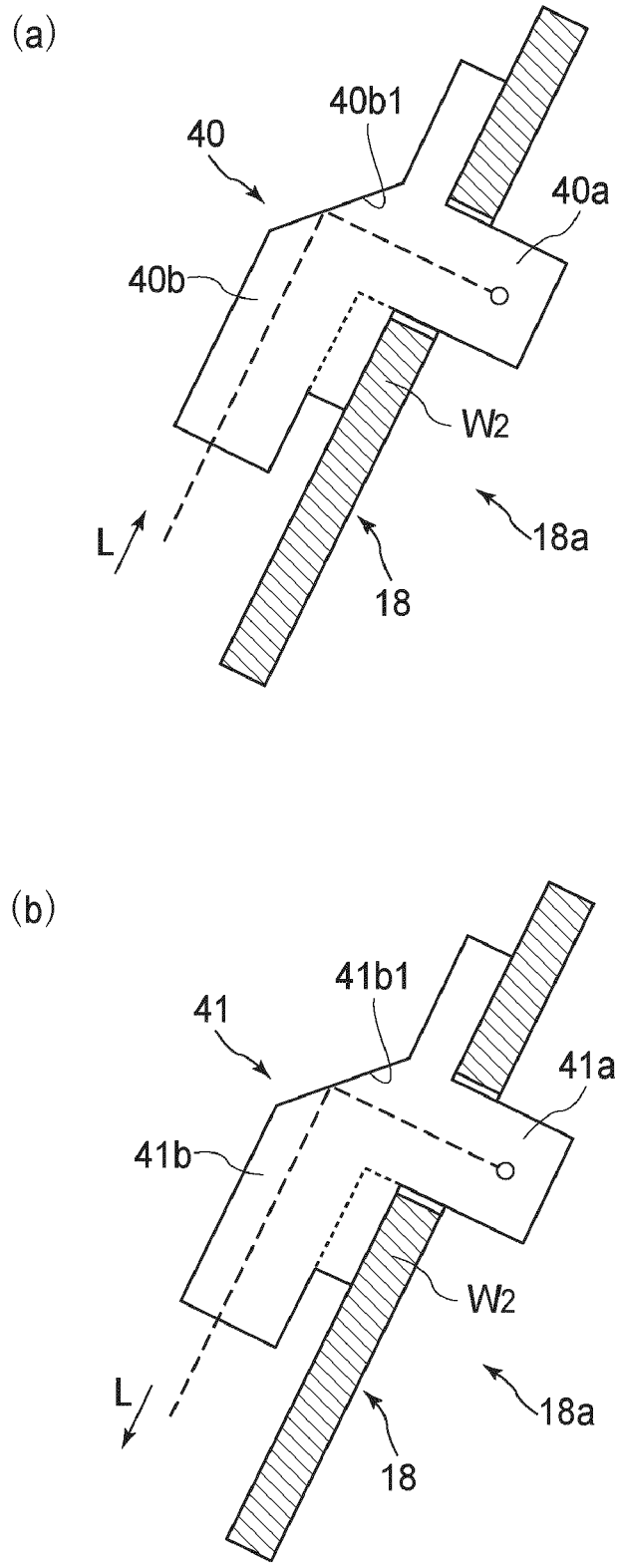
FIGS. 5(*a*) and 5(*b*) are sectional views of the transparent member, at planes A-A and B-B, respectively, in FIG. 4.

Incidentally, referring to FIG. 5(*a*), in order to guide the detection light L from the LED, into the toner storage chamber 18*a*, the light guide portion 40*b* is provided with a reflective intermediary surface 40*b*1. Further, referring to FIG. 4, the light exit surface 40*b*2 of the light guide portion 40*b* squarely faces the light entrance surface 41*b*2 of the light entrance portion 41*b*. Similarly, the light guide portion 41*b* is provided with a reflective surface 41*b*1 so that the light having entered the light guide portion 41*b* through the light entrance surface 41*b*2 is guided to a phototransistor (unshown), as shown in FIG. 5(*b*).

[Method for Detecting Amount of Toner Remainder]

Next, referring to FIGS. 6-12, and 24, the method for detecting the amount of toner remaining will be described in detail.

Figure 6:
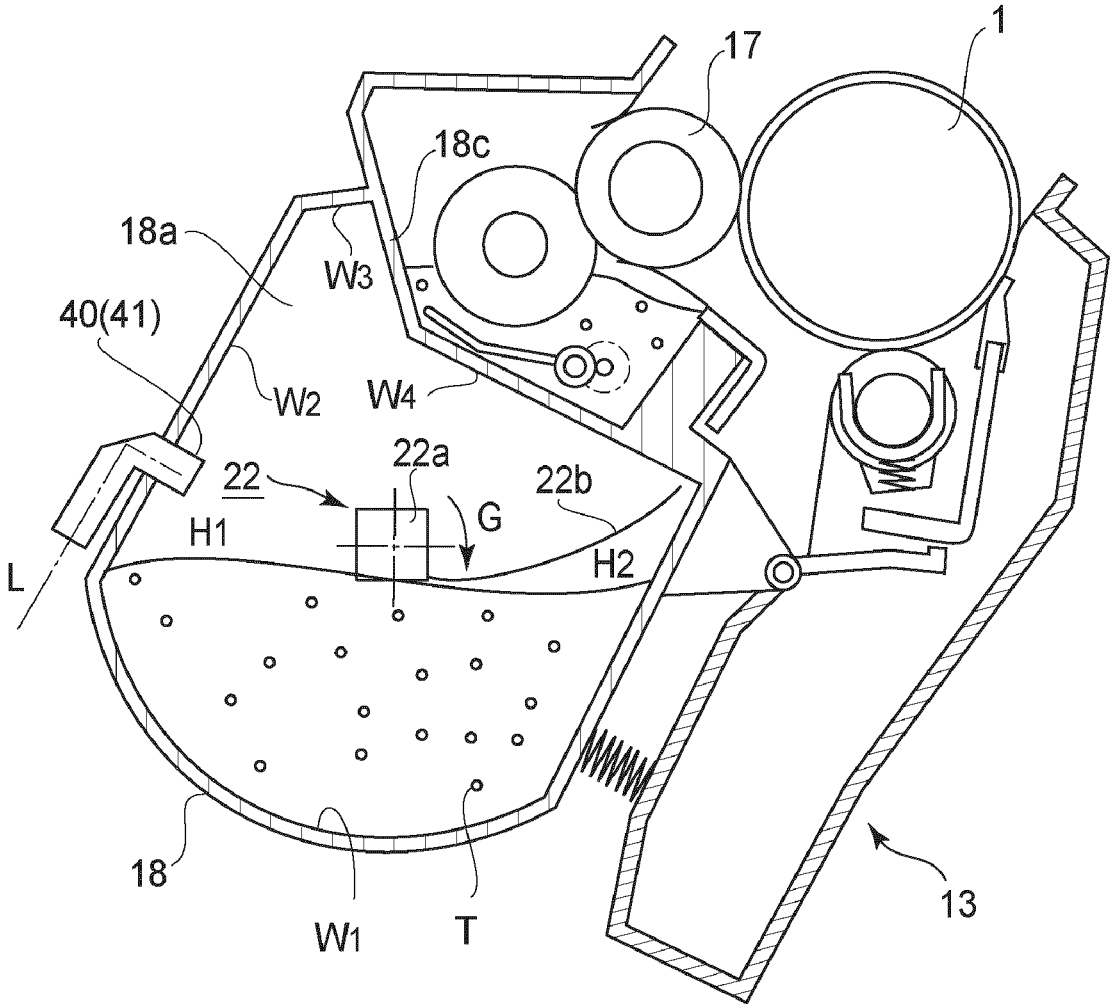
FIG. 6 is a schematic cross-sectional view of the process cartridge, showing the operation of the toner stirring member in the cartridge.
Figure 24:
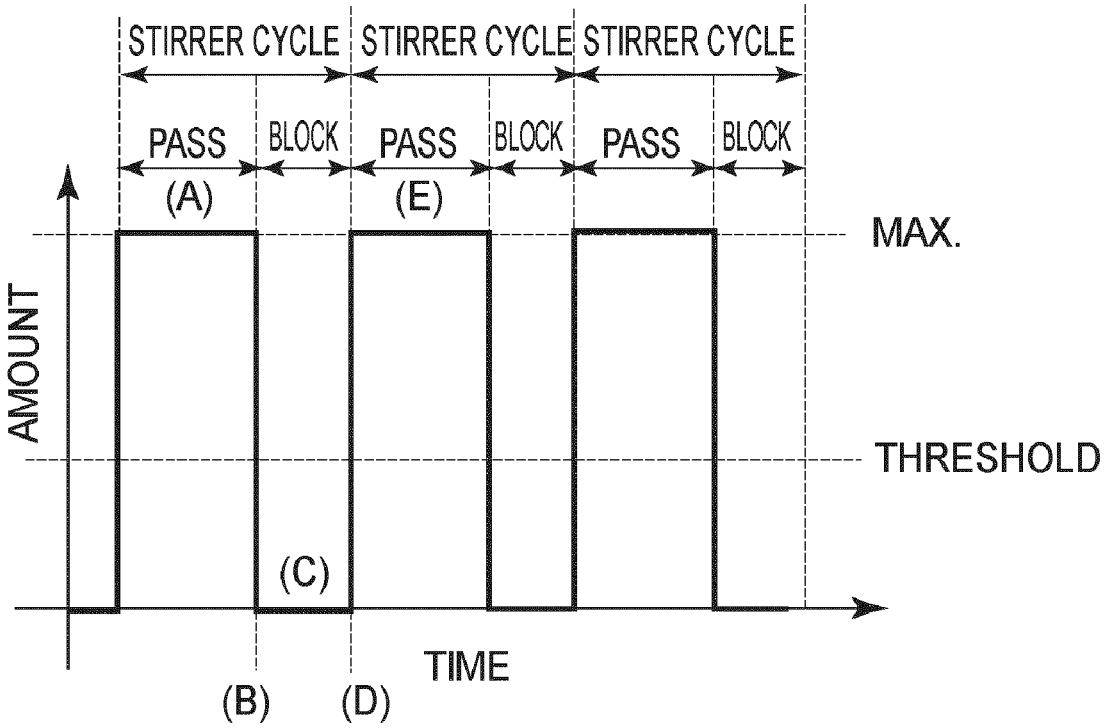
FIG. 24 is a graph showing the changes (waveform) in the relationship between the amount of the remaining developer amount detection light received by the light receiving portion of the image forming apparatus in the first embodiment of the present invention, and the elapsed time.

FIG. 6 is a cross-sectional view of the development unit 4, which is in the state in which the amount of the toner in the storage chamber 18*a* is greater than a preset value, and in which the toner stirring member 22 is above the portion H2 of the top surface of the body of toner T in the toner storage chamber 18*a*. FIG. 24 shows the relationship between the amount of light received by the phototransistor, and the elapsed time. The phototransistor outputs to the control portion (unshown) of the image forming apparatus main assembly (unshown), electrical signals which correspond to the amount of light it receives. As the control portion receives the electrical signals, it measures the duration of the period of time in which the amount of light which the phototransistor received is greater than a preset value (threshold value). Then, it calculates (estimates) the amount of the toner remaining in the toner storage chamber 18*a* from the measured duration.

The portion A of the waveform (pattern) of the graph, in FIG. 24, which shows the changes in the abovementioned relationship between the amount of light received by the phototransistor and the elapsed time, corresponds to the state of the development unit 4 shown in FIG. 6. That is, the top surface of the body of toner in the toner storage chamber 18*a* is below the vertical position of transparent members 40 and 41. Therefore, the detection light L is allowed to be transmitted through the space between the transparent members 40 and 41, in the toner storage chamber 18*a*.

As the stirring member 22 is rotated when the development unit 4 is in the state shown in FIG. 6, the stirring sheet 22*b* presses on the portion H2 of the top surface of the body of toner T in the toner storage chamber 18*a*, that is, the portion of the top surface of the body of toner T, which is on the right-hand side of the axial line of the stirring member 22, in FIG. 6. Therefore, the portion H1 of the top surface of the body of toner T, that is, the portion on the left-hand side of the axial line of the stirring member 22 rises.

Figure 7:
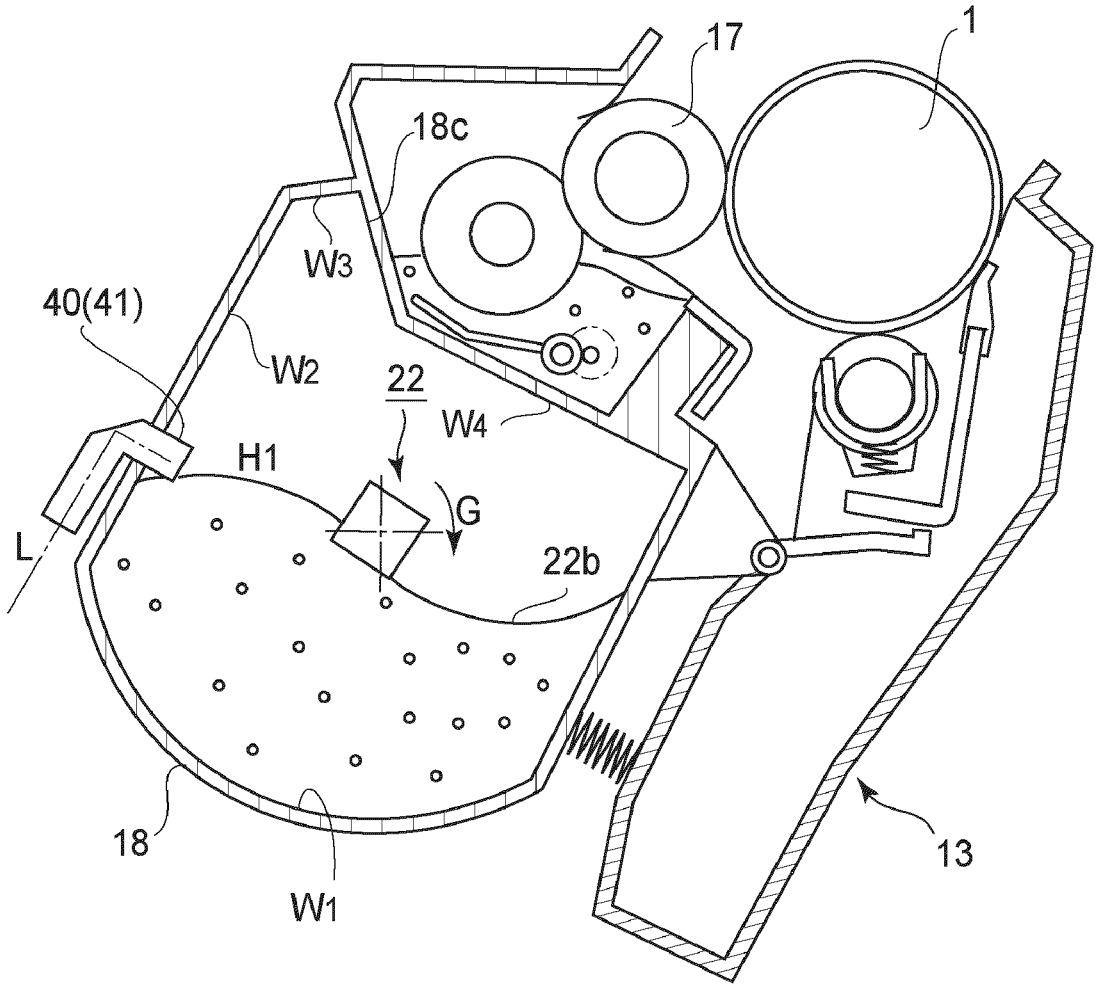
FIG. 7 is a schematic cross-sectional view of the process cartridge, showing the operation of the toner stirring member in the cartridge.

The portion H1 of the top surface of the body of toner T rises along the portion W2, that is, the slanted portion, of the wall of the toner storage chamber 18*a*, eventually reaching the transparent members 40 and 41 as shown in FIG. 7.

Immediately after the portion H1 of the top surface of the body of toner T reaches the transparent members 40 and 41, the detection light L emitted from the LED (unshown) begins to be blocked by the body of toner T which enters the space between the pair of transparent members 40 and 41 which is attached to the wall of the toner storage chamber 18*a*. As a result, the phototransistor (unshown) is prevented from receiving the detection light L (state corresponding to point (B) in graph in FIG. 24).

Figure 8:
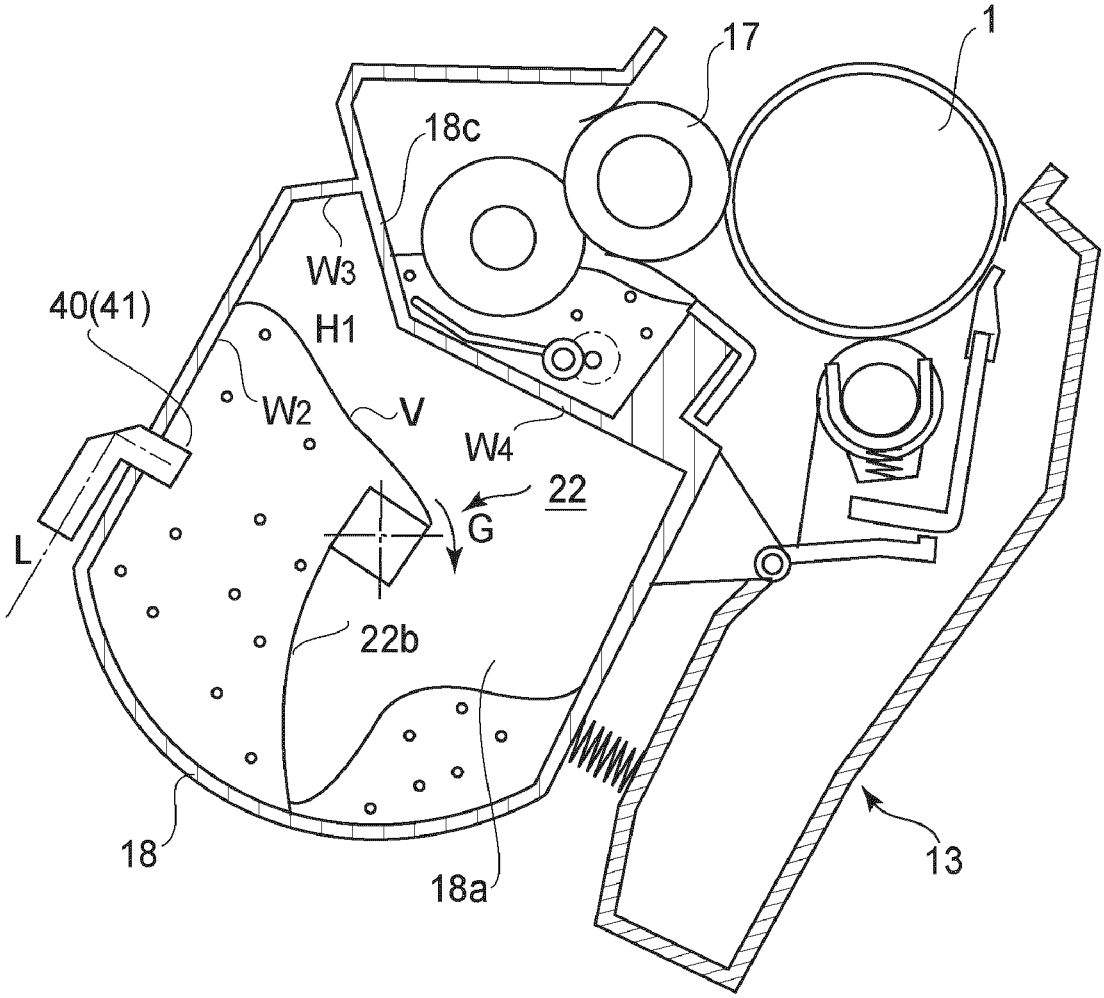
FIG. 8 is a schematic cross-sectional view of the process cartridge, showing the operation of the toner stirring member in the cartridge.

As the toner stiffing member 22 is further rotated, the portion H1 of the top surface of the body of toner T rises along the portion W2 of the internal surface of the toner storage chamber 18*a*, becoming thereby angled (V) relative to the horizontal plane as shown in FIG. 8.

As the angle V of the portion H1 of the top surface of the body of toner T being pressed by the toner stiffing sheet 22*b* becomes as steep as shown in FIG. 8, the body of toner T begins to partially break away and fall from the toner stiffing sheet 22*b*, accumulating again in the bottom portion of the toner storage chamber 18*a*.

At the beginning of the breakaway of the body of toner T, there is still a part of the body of toner T, between the pair of transparent members 40 and 41 attached to the portion W2 of the wall of the toner storage chamber 18*a*, and therefore, the detection light L remains blocked as shown in FIG. 24 (state corresponding to portion (C) in the graph in FIG. 24).

Figure 9:
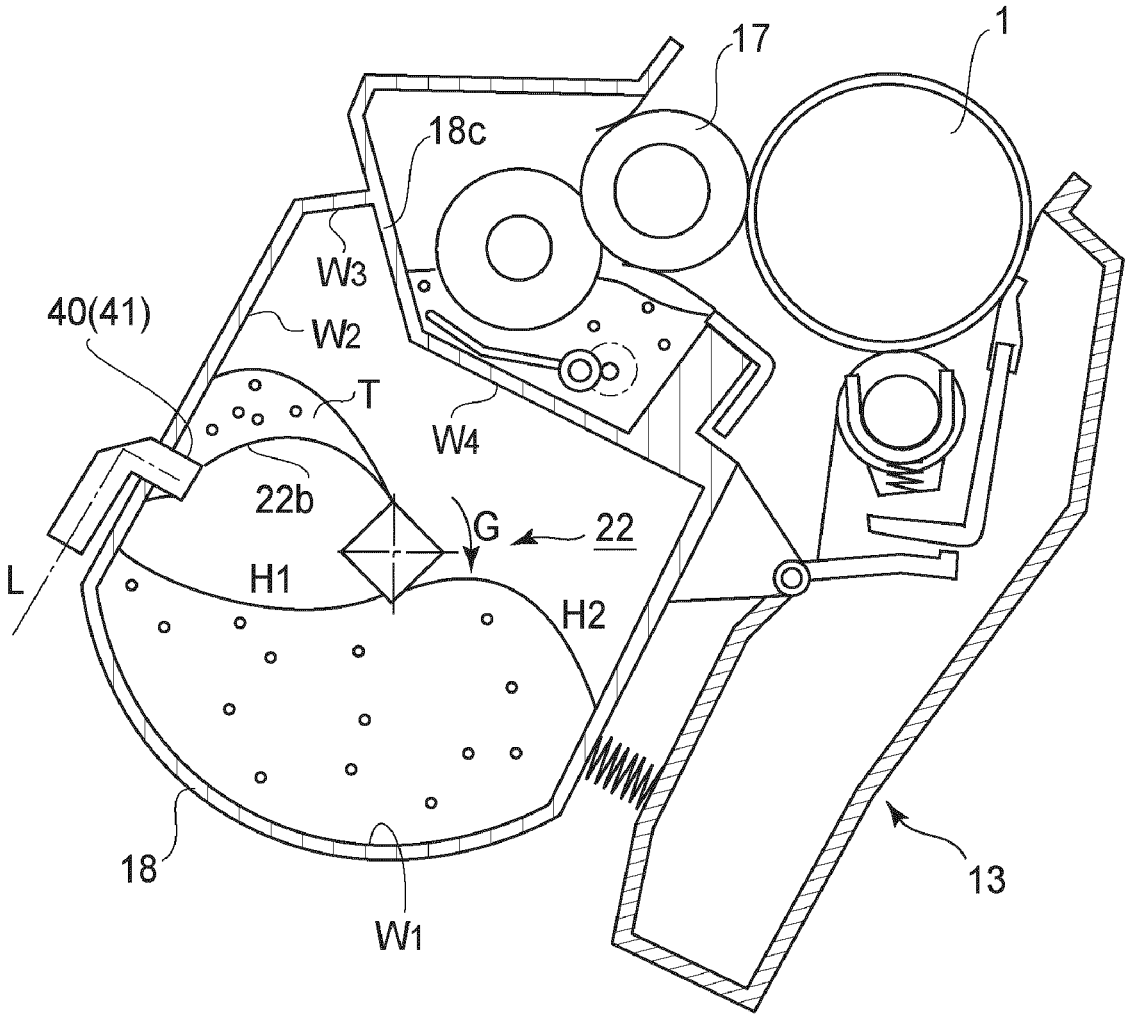
FIG. 9 is a schematic cross-sectional view of the process cartridge, showing the operation of the toner stirring member in the cartridge.

When the development unit 4 is in the state shown in FIG. 9, the stirring sheet 22*b* has just moved past the space between the transparent members 40 and 40 due to the rotation of the toner stirring member 22.

That is, when the development unit 4 is in the state shown in FIG. 9, the body of toner T, which has been pushed up along the internal surface of the portion W2 of the wall of the toner storage chamber 18*a* by the rotation of the toner stiffing member 22, partially remains on the stirring sheet 22*b*. However, since the stirring sheet 22*b* has just moved past the space between the transparent members 40 and 41, which is provided with the portion W2 of the wall of the toner storage chamber 18*a*, there is no toner between the two transparent members 40 and 41, thereby allowing the detection light L to be transmitted through the space between the two transparent members 40 and 41 as shown in FIG. 24 (state corresponding to portion (D) of graph).

Figure 10:
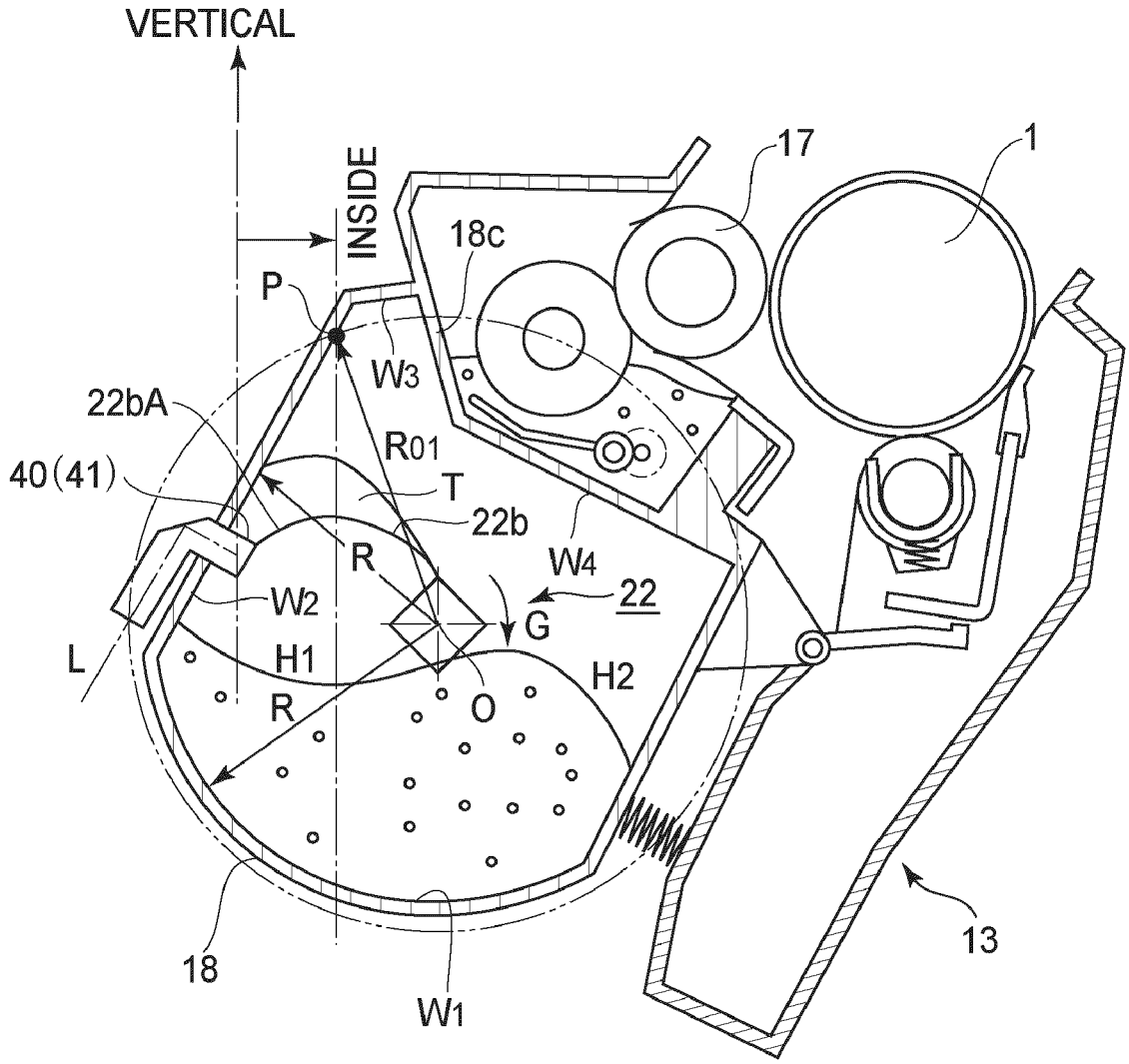
FIG. 10 is a schematic cross-sectional view of the process cartridge, showing the operation of the toner stirring member in the cartridge.

Incidentally, referring to FIG. 10, in this embodiment, the portion W2 of the toner storage chamber wall is tilted toward the axial line of the toner stirring member 22 relative to the vertical plane. Further, in this embodiment, the portion W2 is flat. However, the portion W2 may be curved inward of the toner storage chamber 18*a*.

Thus, while the remaining body of toner T on the stirring sheet 22*b* is pushed up along the portion W2 of the toner storage chamber wall, it does not occur, as shown in FIG. 24, that the remaining body of toner T blocks the detection light L by falling from the stirring sheet 22*b*, that is, it does not occur that the falling body of toner T prevents the detection light L from being transmitted through the space between the transparent members 40 and 41 (state corresponding to portion (E) of graph in FIG. 24).

In this embodiment, the length RO (FIG. 3) of the shorter edges of the stiffing sheet 22*b* (which is roughly the same as distance R01 from the rotational axis O of the toner stirring member 22 to sweeping edge 22*b*A of the stirring sheet 22*b*), is greater than the distance from the axial line O of the stirring member 22 to the internal surface of the portion W2 of the toner storage chamber wall, as described above. Therefore, the possibility that the body of toner T, which is on the stirring sheet 22*b*, partially falls through the gap between the stirring sheet 22*b* and the internal surface of the portion W2 of the toner storage chamber wall is minimized.

Then, as the toner stirring member 22 is further rotated, the toner stirring sheet 22*b* continues to convey the toner along the portion W2 of the toner storage chamber wall, until the sweeping edge 22*b*A of the toner stirring sheet 22*b* separate from the portion W2, at a point P as shown in FIG. 10.

As soon as the sweeping edge 22*b*A (FIG. 3) of the toner stirring sheet 22*b* moves past the point P, the distance R from the rotational axis of the toner stirring member 22 to the internal surface of the toner storage chamber wall becomes greater than the radius RO1 of the sweeping area of the toner stirring sheet 22*b*. Thus, the toner stirring sheet 22*b*, which has been rotated, while remaining elastically bent, instantly straightens, thereby catapulting the body of toner T on the toner stirring sheet 22*b* at the same time.

According to this embodiment, the development unit 4 is structured so that when the process cartridge 7 is in its image forming position in the main assembly of the image forming apparatus, the point P is on the inward side of the toner storage chamber 18*a* relative to the vertical plane coinciding with the most inward edges of the transparent members 40 and 41 with which the portion W2 of the toner storage chamber wall is provided. Therefore, it does not occur, as described above, that the remaining body of toner T on the toner stirring sheet 22*b* falls directly onto the transparent members 40 and 41. Therefore, it does not occur that while the sweeping edge 22*b*A of the toner stirring sheet 22*b* is moving across the portion of the internal surface of the toner storage chamber wall, which is between the transparent members 40 and 41 and point P in terms of the rotational direction of the toner stirring member 22, the detection light L remains blocked by the toner. That is, the amount by which the phototransistor receives the detection light L is unlikely to be affected by the falling toner, as will be evident from the pattern (waveform) of the changes in the relationship between the amount of the detection light L received by the light receiving portion, and the elapsed time, shown in the graph in FIG. 24. Therefore, the threshold value for precisely determining the amount of the toner remainder can be easily set.

Next, referring to FIGS. 11 and 12, the changes in the length of time the detection light L remains blocked, which is caused by the changes in the amount of the toner remainder in the toner storage chamber 18*a*, will be described.

Figure 11:
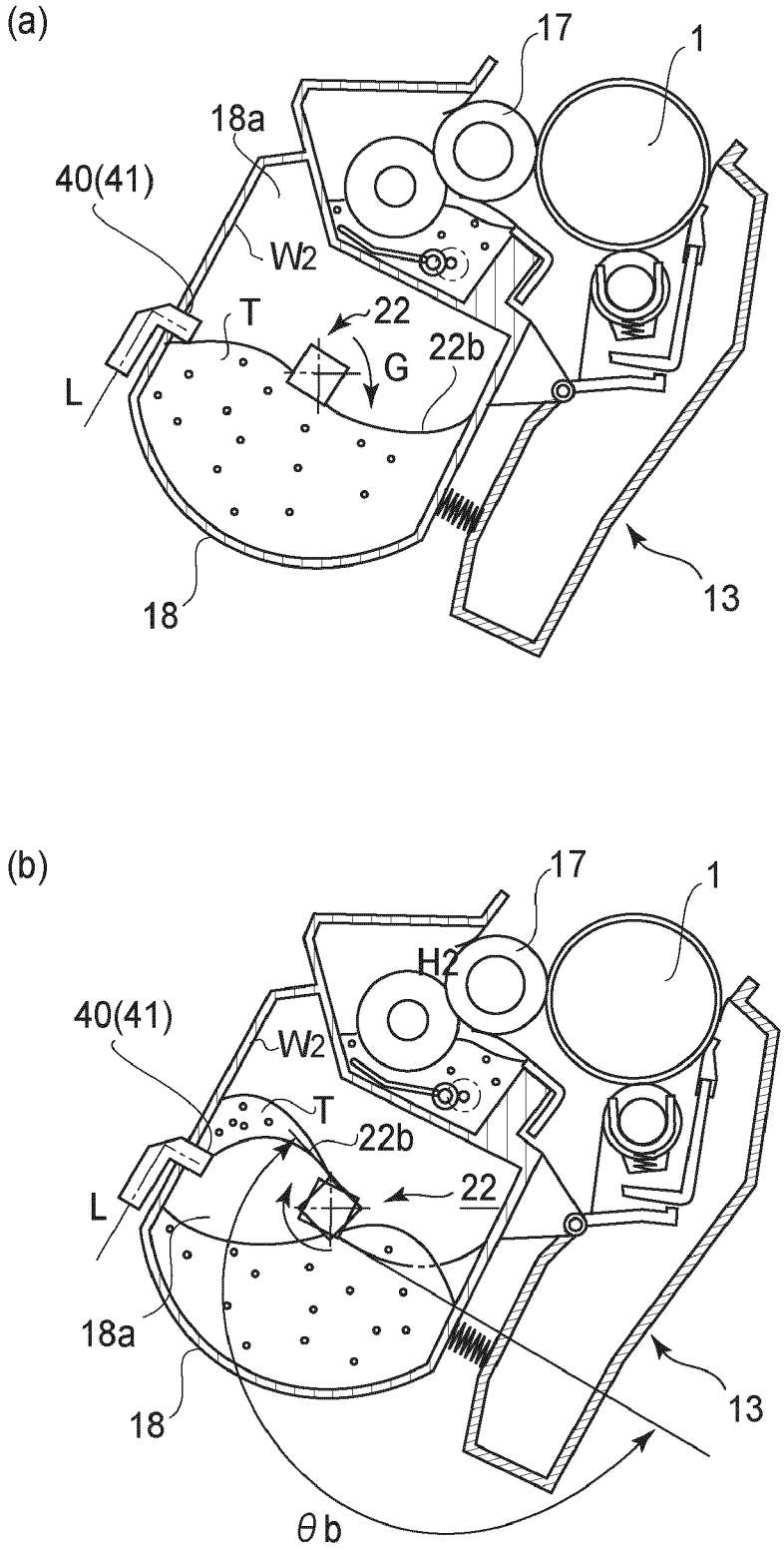
FIGS. 11(*a*) and 11(*b*) are schematic cross-sectional views of the process cartridge, showing the operation of the toner stirring member in the cartridge.

FIGS. 11(*a*) and 11(*b*) correspond to the case in which the amount of the toner remaining in the toner storage chamber 18*a* is relatively large.

Figure 25:
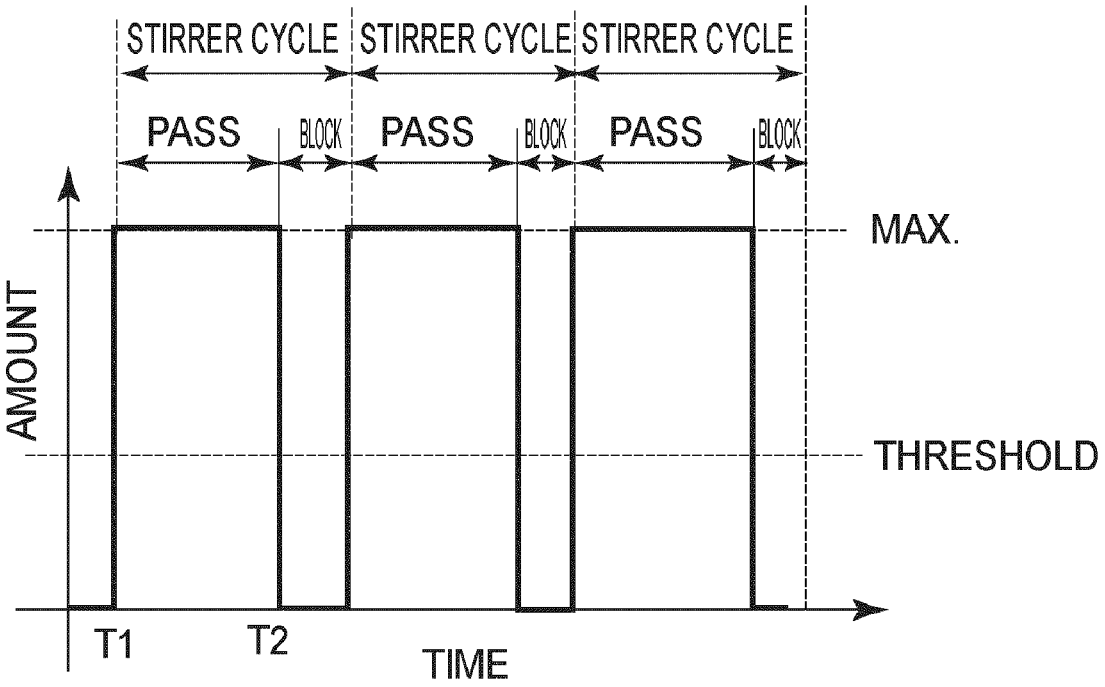
FIG. 25 is a graph showing the changes (waveform) in the relationship between the amount of the remaining developer amount detection light received by the light receiving portion of the image forming apparatus when the amount of the remaining toner in the toner storage chamber is relatively large, and the elapsed time.

FIG. 25 shows the relationship (waveform) between the amount of detection light L which the phototransistor (unshown) receives when the amount of the toner remaining in the toner storage chamber 18*a* is relatively large, and the elapsed time.

FIG. 11(*a*) is a cross-sectional view of the development unit 4, which corresponds to a point T1 (FIG. 25) in elapsed time, at which the body of toner T has just reached the transparent members 40 and 41 by being pushed by the toner stirring sheet 22*b*. As will be evident from FIG. 25, the point T1 in elapsed time is the point in time at which the detection light L, which has been allowed to be transmitted through the space between the transparent members 40 and 41, has just begun to be blocked by the body of toner T.

FIG. 11(*b*) is a cross-sectional view of the development unit 4, which corresponds to a point T2 (FIG. 25) in elapsed time, at which the toner stirring sheet 22*b* has just moved past the space between the transparent members 40 and 41. As will be evident from FIG. 25, the point T2 in elapsed time is the point in elapsed time at which the body of toner T on the toner stiffing sheet 22*b* has just moved out of the space between the transparent members 40 and 41, which is provided with the portion W2 of the toner storage chamber wall, that is, the point in elapsed time at which the detection light L has just begun to be transmitted again through the space between the transparent members 40 and 41.

While the state of the process cartridge 7 changes from the state shown in FIG. 11(*a*) to the state shown in FIG. 11(*b*), the toner stiffing member 22*b* rotates by an angle θb.

Figure 12:
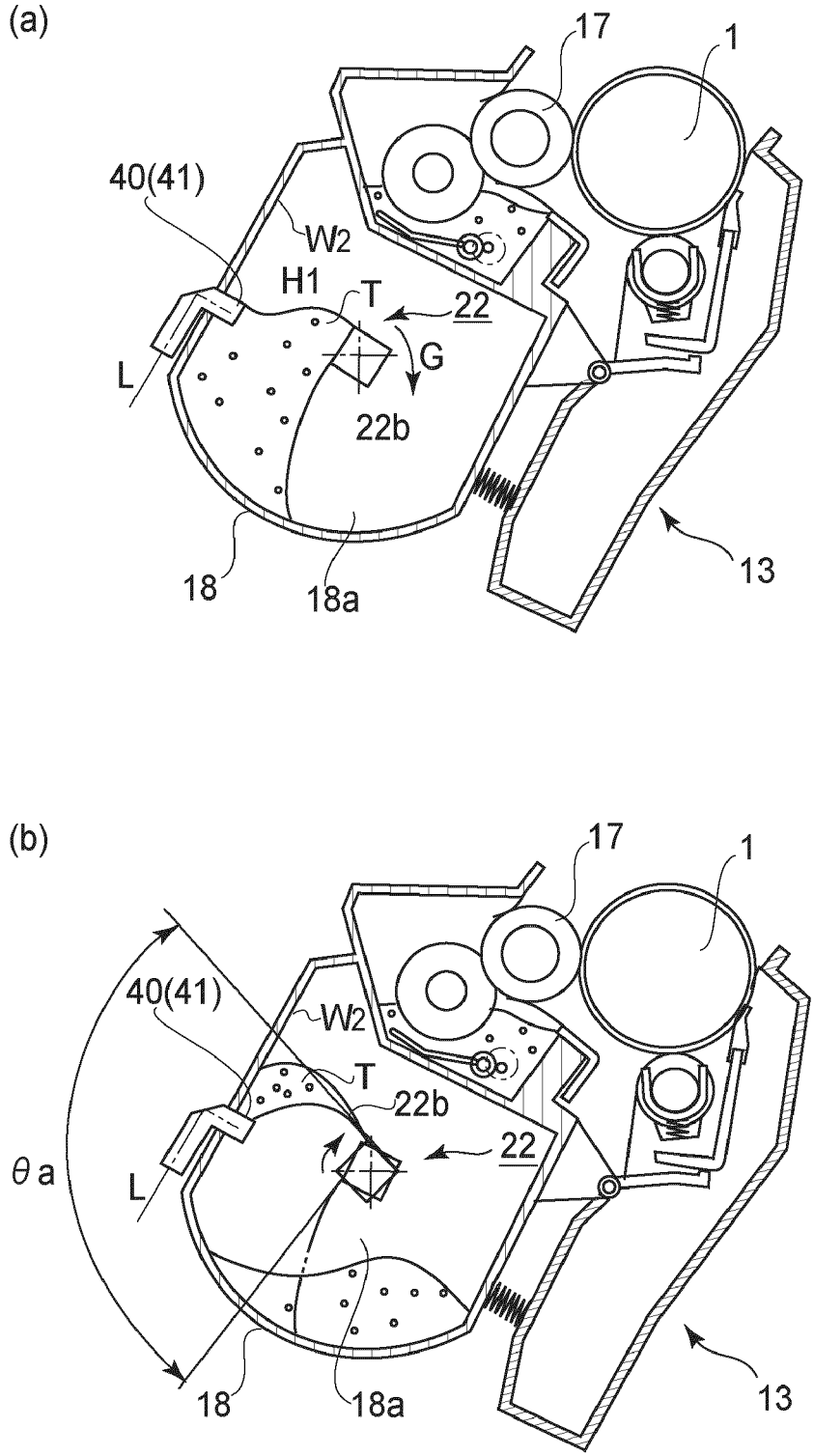
FIGS. 12(*a*) and 12(*b*) are schematic cross-sectional views of the process cartridge, showing the operation of the toner stirring member in the cartridge.
Figure 13:
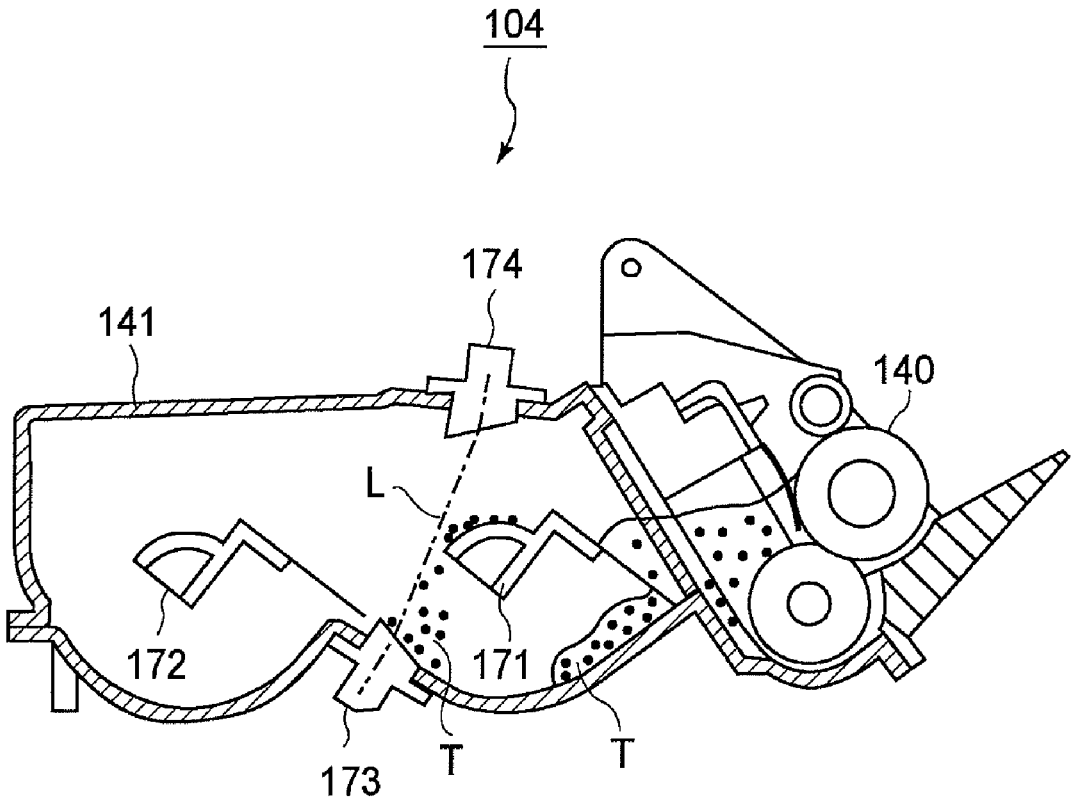
FIG.13 PRIOR ART
FIG. 13 is a schematic cross-sectional view of a typical process cartridge in accordance with the prior art.
Figure 26:
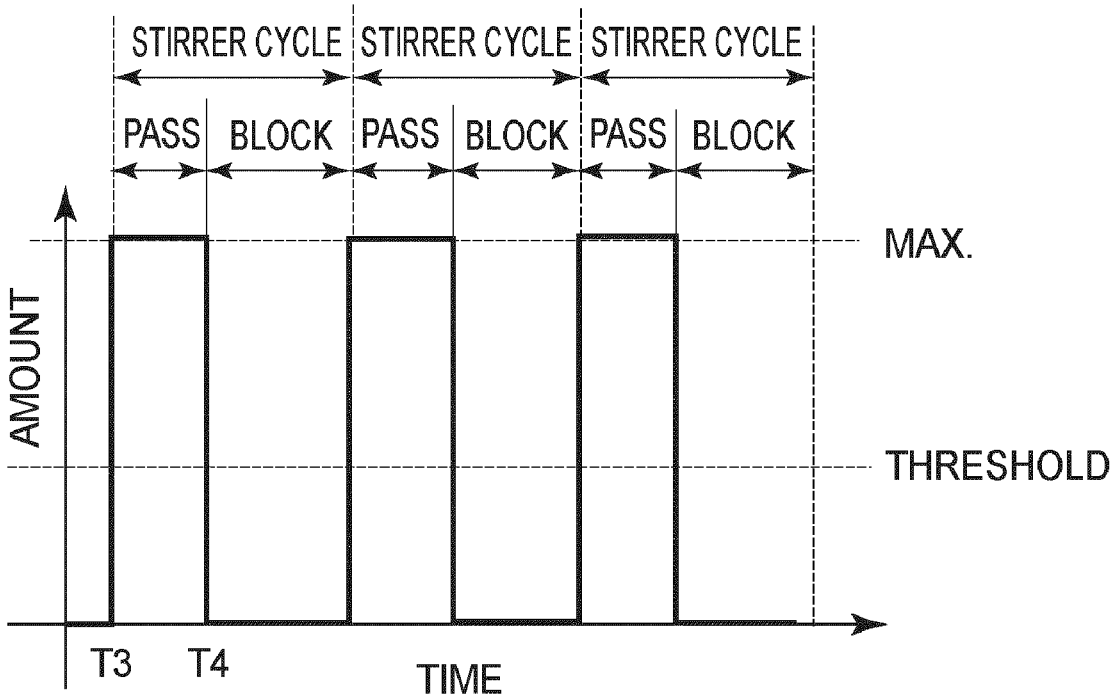
FIG. 26 is a graph showing the changes (waveform) in the relationship between the amount of the remaining developer amount detection light received by the light receiving portion of the image forming apparatus when the amount of the remaining toner in the toner storage chamber is relatively small, and the elapsed time.

FIGS. 12(*a*) and 12(*b*) correspond to the case in which the amount of toner remaining in the toner storage chamber 18*a* is half the amount of toner remaining in the toner storage chamber 18*a* when the development unit 4 is in the state shown in FIGS. 11(*a*) and 11(*b*). FIG. 26 shows the relationship (waveform) between the amount of detection light L which the phototransistor (unshown) received when the amount of the toner remaining in the toner storage chamber 18*a* was as shown in FIGS. 12(*a*) and 12(*b*), and the elapsed time.

The angle by which the toner stirring member 22 rotates during the period between a point T3 in elapsed time (FIG. 26) at which the detection light L begins to be blocked again as shown in FIG. 12(*a*), and a point T4 (FIG. 26) in elapsed time at which the detection light L begins to be transmitted again though the space between the transparent members 40 and 41 as shown in FIG. 12(*b*) is θa.

As described above, the amount of toner remaining in the toner storage chamber 18*a* is estimated based on the fact that the angle (θ) by which the toner stiffing member 22 rotates from the moment the detection light L begins to be blocked to the moment the detection light L begins to be allowed to be transmitted again through the space between the transparent members 40 and 41 is affected by the amount of toner remaining in the toner storage chamber 18*a*.

According to the present invention, the body of toner T, which is being pushed up along the smooth inward surface of the portion W2 of the toner storage chamber wall, being therefore stable in behavior, is used to block the detection light L, or allow the detection light L to transmit through the space between the transparent members 40 and 41. Therefore, the length of time the detection light L remains blocked, and the length of time the detection light L is allowed to be transmitted through the space between the transparent members 40 and 41, are stable. Therefore, the amount of the remaining toner can be more precisely detected.

Further, in this embodiment, the detection light L which is transmitting through the space between the transparent members 40 and 41 is blocked by pushing up the toner in the toner storage chamber 18*a* along the portion W2 of the wall of the toner storage chamber 18*a*, which is tilted toward the axial line of the toner stirring member 22 relative to the vertical direction, by the rotational toner stirring member 22. Further, the transparent members 40 and 41 are attached to the portion W2 of the wall of the toner storage chamber 18*a*, which is tilted toward the axial line of the toner stirring member 22. Therefore, toner does not settle on the transparent members 40 and 41. Moreover, referring to FIG. 10, the development unit 4 is structured so that when the process cartridge is in its image forming position in the main assembly of the image forming apparatus, the point P of the inward surface of the toner storage chamber wall, which corresponds to the point in elapsed time at which the sweeping edge of the stirring sheet 22*b* becomes freed from the portion W2 of the toner storage chamber wall, is on the inward side of the vertical plane which coincides with the most inward edges of the transparent members 40 and 41, that is, the point P is closer to the rotational axis of the toner stirring member 22 than the most inward edges of the transparent members 40 and 41. Therefore, it does not occur that as the excessive portion of the body of toner T which is being conveyed by the toner stirring member 22 falls, it disturbs the detection light L. Therefore, it is ensured that the amount of the remaining toner in the toner storage chamber 18*a* is precisely detected.

Embodiment 2

Next, the second embodiment of the present invention will be described.

Incidentally, the portions of the process cartridge and image forming apparatus in this embodiment, the description of which will be a duplication of the description of the counterparts in the first embodiment, will not be described here.

[Process Cartridge]

Figure 14:
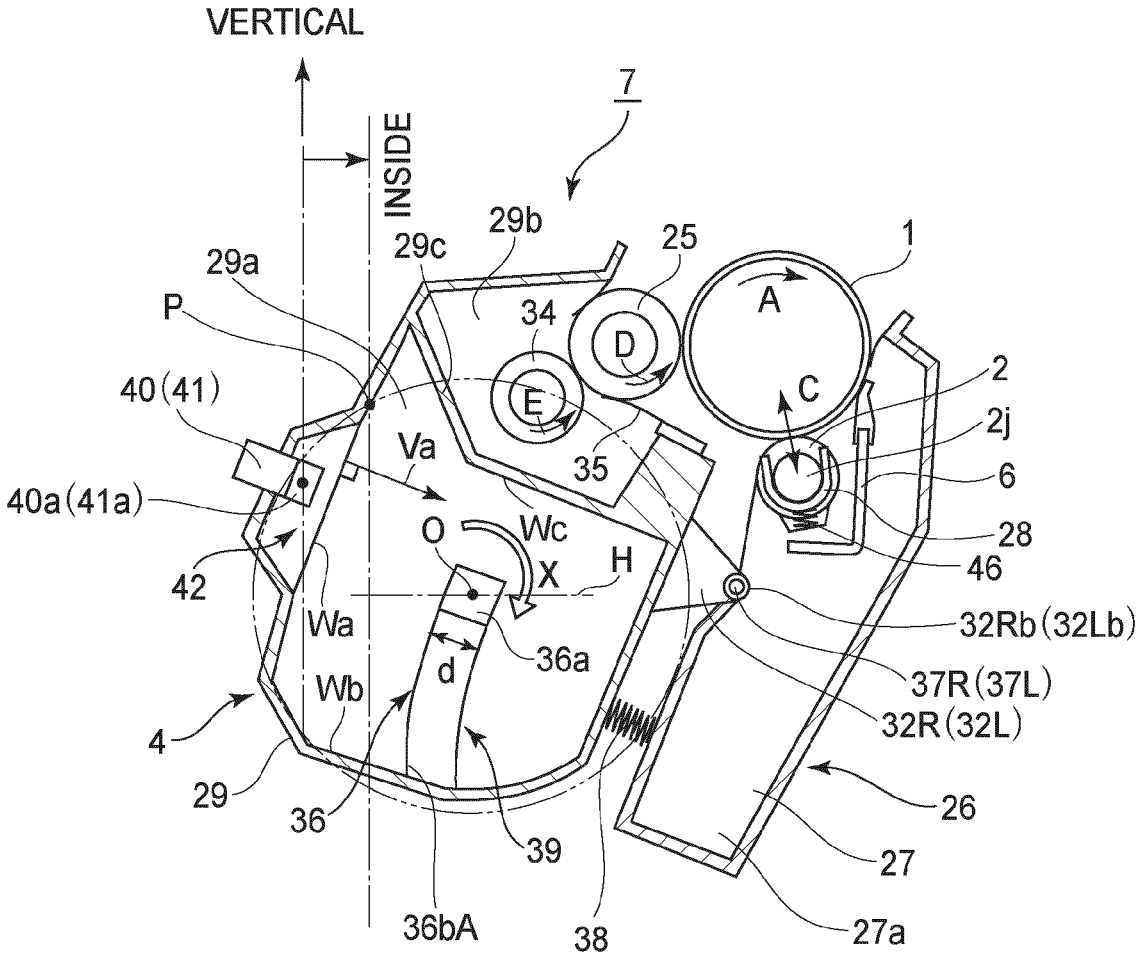
FIG. 14 is a schematic cross-sectional view of the process cartridge in another (second) embodiment of the present invention, showing the general structure of the cartridge.

Referring to FIG. 14, the process cartridge 7 (7*a*-7*d*) in this embodiment will be described. FIG. 14 is a schematic cross-sectional view of the process cartridge 7 (7*a*-7*d*) in this embodiment, which is in its image forming position in the main assembly 100A of the electrophotographic image forming apparatus (FIG. 1).

In this embodiment, a cartridge 7*a*, which contains yellow toner, a cartridge 7*b*, which contains magenta toner, a cartridge 7*c*, which contains cyan toner, and a cartridge 7*d*, which contains black toner, are the same in structure.

The process cartridge 7 (7*a*-7*d*) is made up of a photosensitive member unit 26 and a development unit 4 (4*a*-4*d*). Next, the two units 26 and 4 will be described.

The photosensitive member unit 26 is provided with a photosensitive drum 1 (1*a*-1*d*), a charge roller 2 (2*a*-2*d*), and a cleaning member 6 (6*a*-6*d*).

To the cleaning means frame 27 of the photosensitive member unit 26, the photosensitive drum 1 is rotatably attached with interposition of a pair of unshown bearings. In the adjacencies of the peripheral surface of the photosensitive drum 1, the charge roller 2, and cleaning member 6 are disposed as descried above. As the residual toner is removed from the peripheral surface of the photosensitive drum 1 by the cleaning member 6, it falls into a chamber 27*a* for the removed residual toner. As the driving force from a driving motor (unshown) is transmitted to the photosensitive member unit 26, the photosensitive drum 1 is rotationally driven in the direction indicated by an arrow mark A in synchronism with the progression of the image forming operation.

To the cleaning means frame 27, a pair of charge roller bearings 28 are attached so that the bearings 28 are movable in the direction indicated by a double-headed arrow mark C, the theoretical extension of which coincides with the axial lines of the charge roller 2 and photosensitive drum 1. The shaft 2*j* of the charge roller 2 is rotatably borne by the pair of charge roller bearings 28, which are kept pressured toward the photosensitive drum 1 by a pair of pressure applying members 46.

The developing means frame 29 of the development unit 4 has a developer storage chamber 29*a* (which hereafter will be referred to as the toner chamber) and a development chamber 29*b*. The toner chamber 29*a* stores toner. There is a development roller 25, as a developer bearing member, in the development chamber 29*b*. The development roller 25 rotates in contact with the photosensitive drum 1, in the direction indicated by an arrow mark D.

In this embodiment, the development chamber 29*b* is above the toner chamber 29*a*. The toner chamber 29*a* and development chamber 29*b* are in connection with each other, through a hole 29*c*, which is provided with the partition wall between the two chambers 29*b* and 29*a*.

The development roller 25 in the development chamber 29*b* is rotatably supported by a developing means frame 29. More specifically, the development roller 25 is supported at its lengthwise end portions by a pair of bearings (unshown) attached to the lengthwise ends of the developing means frame 29.

The development unit 4 is also provided with a developer supply roller 34 (which hereafter will be referred to as the toner supply roller) and a development blade 35, which are in the adjacencies of the peripheral surface of the development roller 25. The toner supply roller 34 rotates in contact with the development roller 25 in the direction indicated by an arrow mark E. The development blade 35 is a blade for regulating the thickness of the toner layer on the peripheral surface of the development roller 25.

Further, the toner chamber 29*a* of the developing means frame 29 is provided with a recess 42 which is recessed outward from the toner chamber 29*a*, as will be described later in detail. This recess 42 is provided with a pair of transparent members 40 and 41 as developer remainder amount detecting members (which is a means for detecting the amount of developer (toner) remainder) for detecting the amount of the developer remaining in the toner chamber 29*a*. The transparent members 40 and 41 are provided with a light exit portion 40*a*, through which the detection light L exits from the transparent member 40, whereas the transparent member 41 has a light entrance portion 41*a*, through which the detection light L enters the transparent member 41, respectively.

Further, there is a developer stirring member 36 (which hereafter will be referred to as the toner stirring member) for stirring the toner in the toner storage chamber 29*a* while conveying the toner to the abovementioned toner supply roller 34. The toner stirring member 36 is provided with a cleaning member 39 (which hereafter may be referred to as the transparent member cleaning member) for cleaning the light exit portion 40*a* and light entrance portion 41*a*.

The development unit 4 is pivotally connected to the photosensitive member unit 26. More specifically, the bearing members 32R and 32L are provided with holes 32Rb and 32Lb, and a pair of connective pins 37R and 37L are put through the holes 32Rb and 32Lb and the corresponding holes of the photosensitive member unit 26 so that the development unit 4 is pivotally movable relative to the photosensitive member unit 26. When the process cartridge 7 is being used for image formation, the development unit 4 is under the pressure from compression springs 38 for pressing the development unit 4. Therefore, during an image forming operation, the process cartridge 7 is pivoted about the connective pins 37 R and 37L, whereby the development roller 25 is placed in contact with the photosensitive drum 1.

[Structure of Toner Stirring Member, Structure of Member for Cleaning Light Exit and Entrance Portions, and Toner Remainder Amount Detection Based on Amount of Light Transmission]

Next, referring to FIGS. 14-18, the structure of the toner stirring member 36, the structure of the member for cleaning the light exit portion and light entrance portion of the transparent members 40 and 41, respectively, and the detection of the remaining toner amount based on the amount of light transmission, will be described.

Referring to FIG. 14, there is a toner stirring member 36 in the toner chamber 29*a* which stores toner. The toner in the toner chamber 29*a* is conveyed to a toner supply roller 34 through the hole 29*c*, by rotating the stirring member 36 in the direction X. Incidentally, also in this embodiment, the development unit 4 is structured so that the point P at which the sweeping edge of the toner stirring member 36 is freed from the internal surface of the portion Wa of the toner storage chamber wall, is on the inward side of the vertical plane, which coincides with the most inward edges of the transparent members 40 and 41, that is, the vertical plane which coincides with the point P is closer to the rotational axis O of the toner stirring member 36 than the vertical plane coinciding with the most inward edges of the transparent members 40 and 41.

Referring to FIG. 14, the wall of the toner chamber 29*a* has a bottom portion Wb and a lateral portion Wa. The bottom portion Wb is the portion which is at the bottom when the cartridge is properly set in its image forming position, that is, when the position of the cartridge is as shown in FIG. 14. In terms of the rotational direction of the toner stirring member 36, the lateral portion Wa is on the downstream side of the bottom portion Wb. It is tilted toward the axial line of the toner stirring member 36, relative to the vertical direction. It is the lateral portion Wa that is provided with the recess 42 which is provided with the pair of toner remainder amount detecting members, that is, the transparent members 40 and 41, as will be described later in detail. Further, the wall of the toner chamber 29*a* has a portion Wc, that is, the rest of the wall of the toner chamber 29*a*, which is between the abovementioned tilted portion Wa (lateral portion) and portion Wb (bottom portion) in terms of the rotational direction of the toner stirring member 36, and connects the two portions Wa and Wb of the wall of the toner chamber 29*a*.

As the toner stirring member 36 is rotated in the toner chamber 29*a*, the sweeping edge 36*b*A moves in contact with the bottom portion Wb, lateral portions Wa (tilted portion), etc., as will be described later in detail. Thus, the toner T in the toner chamber 29*a* is guided to the hole 29*c* along the bottom portion Wb, and then, along the portion Wa.

More specifically, as the toner stirring member 36 is rotated, a part of the body of toner T in the toner chamber 29*a* fails to be guided into the hole 29*c*, that is, it falls from the toner stirring member 36 and settles back in the bottom portion of the toner chamber 29*a*, whereas the other part is guided inward of the toner chamber 29*a*, along the portion We of the toner storage chamber wall, by the toner stirring member 36.

Figure 15:
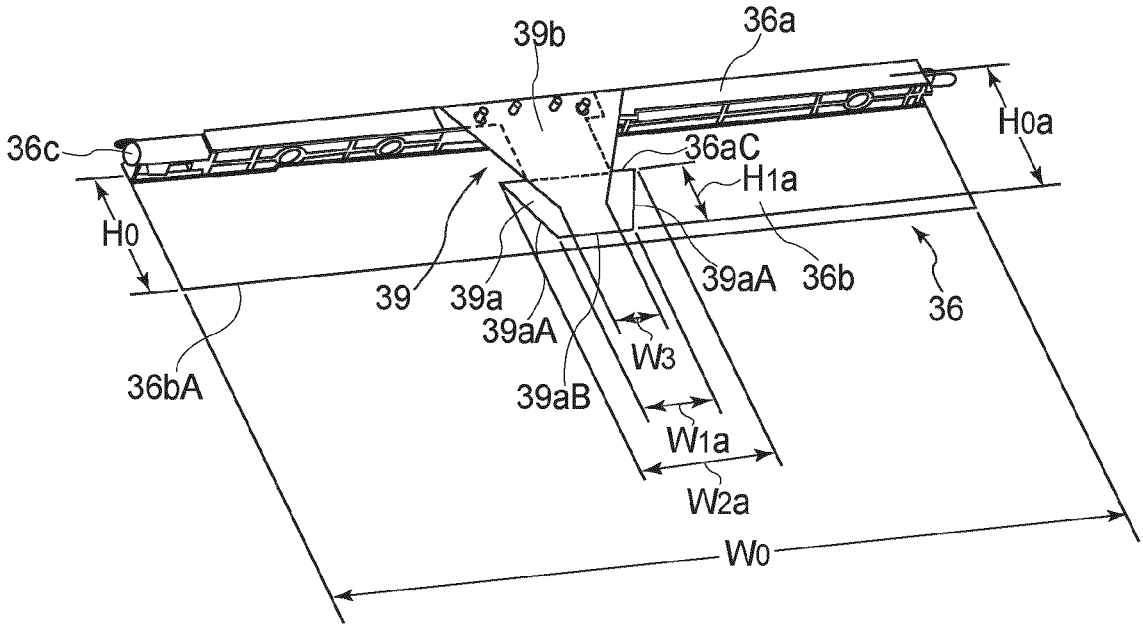
FIG. 15 is a perspective view of the stirring member and transparent member cleaning member of the developing apparatus in accordance with the present invention.

Referring to FIG. 15, the toner stirring member 36 is made up of a shaft 36*a* and a stirring sheet 36*b*. The shaft 36*a* is molded of a resinous substance. The stirring sheet 36*b* is the very portion of the toner stirring member 36 that stirs toner. It is a rectangular sheet made of flexible resinous sheet. Its longer edges, that is, the edges parallel to the lengthwise direction of the shaft 36*a*, have a length of W0, and its shorter edges, that is, the edges parallel to the radius direction of the sweeping area of the stirring sheet 36*b*, that is, the distance from the rotational axis of the shaft 36*a* to the sweeping edge of the stirring sheet 36*b*, have a length of H0. The stirring sheet 36*b* is attached to the shaft 36*a* by one of the longer edges.

In terms of the stirring member rotation direction, the cleaning member 39 for cleaning the light exit surface 40*a* and light entrance surface 41*a* is on the downstream side of the stirring sheet 36*b*. The cleaning member 39 is made up of a wiping sheet 39*a* and an auxiliary wiping sheet 39*b*. The wiping sheet 39*a* is a flexible sheet for wiping away the toner having adhered to the light exit surface 40*a*, and the light entrance surface 41*a*. The auxiliary wiping sheet 39*b* is a member which assists the wiping sheet 39*a* in cleaning the light exit surface 40*a* and light entrance surface 41*a*. The auxiliary wiping sheet 39*b* is attached to the shaft 36*a* by one of its edges parallel to the shaft 36*a*. It is also attached to the wiping sheet 39*a* by the other edge parallel to the shaft 36*a*. That is, the auxiliary wiping sheet 36*b* plays the role of the supporting member for attaching the wiping sheet 39*a* to the shaft 36*a*.

Referring to FIGS. 14 and 15, in this embodiment, the shaft 36*a* is rectangular in cross section. The toner stirring member 36 (stirring sheet 36*b*) is attached to one of the surfaces of the shaft 36*a*. The transparent member cleaning member 39 (more specifically, auxiliary wiping sheet 39*b*) is attached to the opposite surface of the shaft 36*a* from the surface to which the toner stirring member 36 is attached. Therefore, in terms of the rotational direction of the toner stirring member 36, the transparent member cleaning member 39 is on the downstream side relative to the toner stirring member 36 by a distance equivalent to the measurement (d) of the shaft 36*a* (FIG. 14).

To describe in more detail, the wiping sheet 39*a* is in the form of an isosceles trapezoid. That is, the wiping edge 39*a*B of the wiping sheet 39*a*, that is, the outward edge in terms of the radius direction of the sweeping area of the toner stirring member 36 is narrower (W1*a*) than the edge 36*a*C, that is, the inward (other) edge (W2*a*) in terms of the abovementioned radius direction, which is closer to the shaft 36*a* by the height H1*a* (W1*a*<W2*a*). As will be described later in more detail, the pair of lateral edges 39*a*A of the trapezoidal wiping sheet 39*a* wipe away the toner having adhered to the light exit surface 40*a* and light entrance surface 41*a*, by coming into contact with the light exit surface 40*a* and light entrance surface 41*a*. Further, the distance H0*a* from the axial line of the shaft 36*a* to the wiping edge 39*a*B of the wiping sheet 39*a* is roughly the same in value as the abovementioned measurement H0 of the stirring sheet in terms of the radius direction of the sweeping area of the toner stirring member 36.

The stirring sheet 36*b* and wiping sheet 39*a* can be easily made of flexible resinous sheet, such as polyester film, polyphenylene sulfide film, or the like. The thickness of the stirring sheet 22*b* is desired to be in a range of 50-250 μm.

The force for driving the stirring member 36 is transmitted to the stirring member 36 by a driver gear (unshown) attached to one of the lengthwise ends of the shaft 36*a*; the shaft of the driver gear is inserted in the hole 36*c*, which is provided with one of the lengthwise ends of the shaft 36*a*, through a hole, which is provided with one of the lateral walls of the toner chamber 29*a* of the developing means frame 29.

Figure 18:
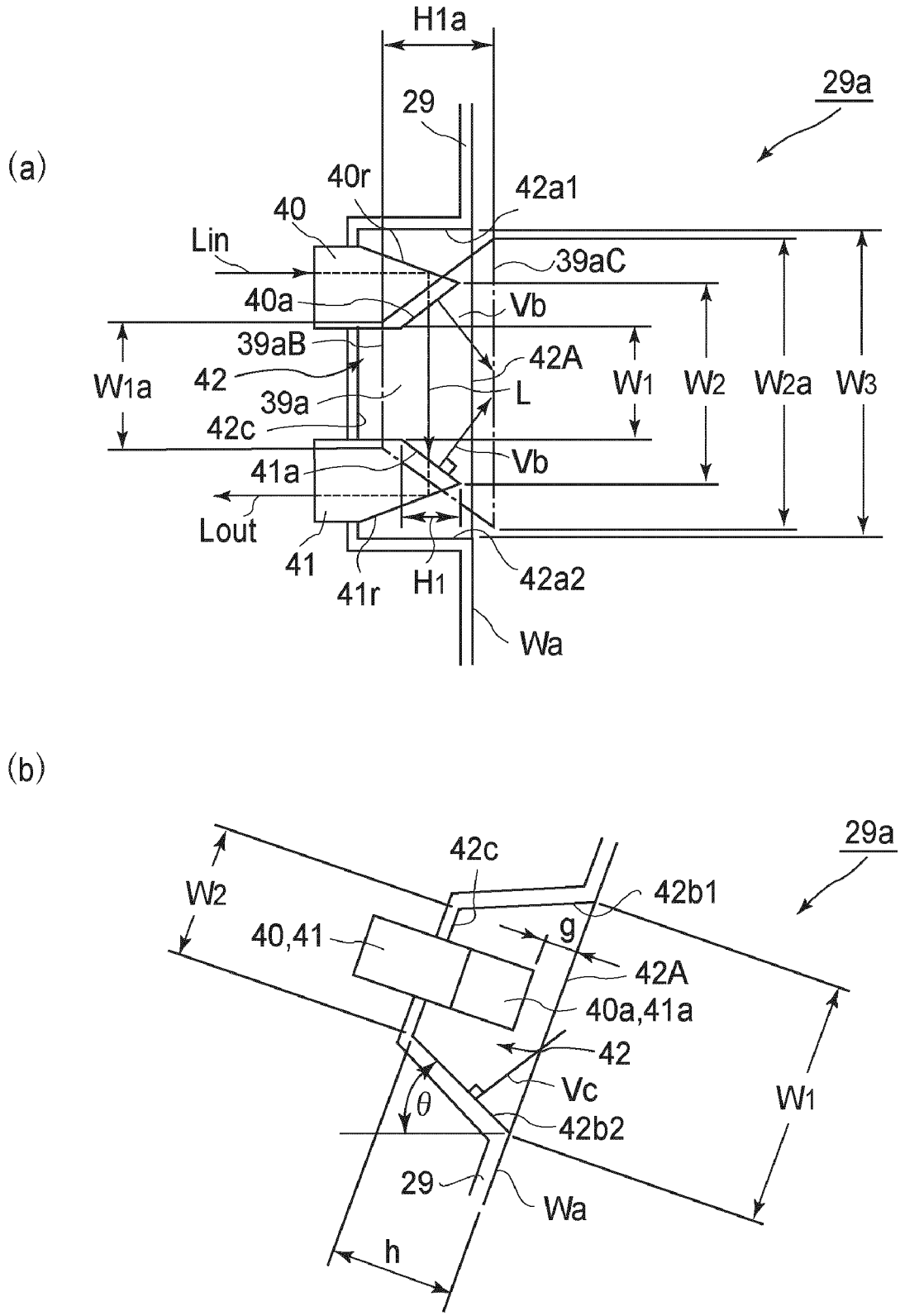
FIG. 18(*a*) is a horizontal sectional view of a transparent member of the light transmission type, which is made up of a pair of transparent portions for detecting the amount of the remaining toner based on the amount of light transmission, and FIG. 18(*b*) is a vertical sectional view (at a plane parallel to the front panel of the apparatus) of the transparent member of the light transmission type, which is made up of a pair of transparent portions for detecting the amount of the remaining toner based on the amount of light transmission.
Figure 19:
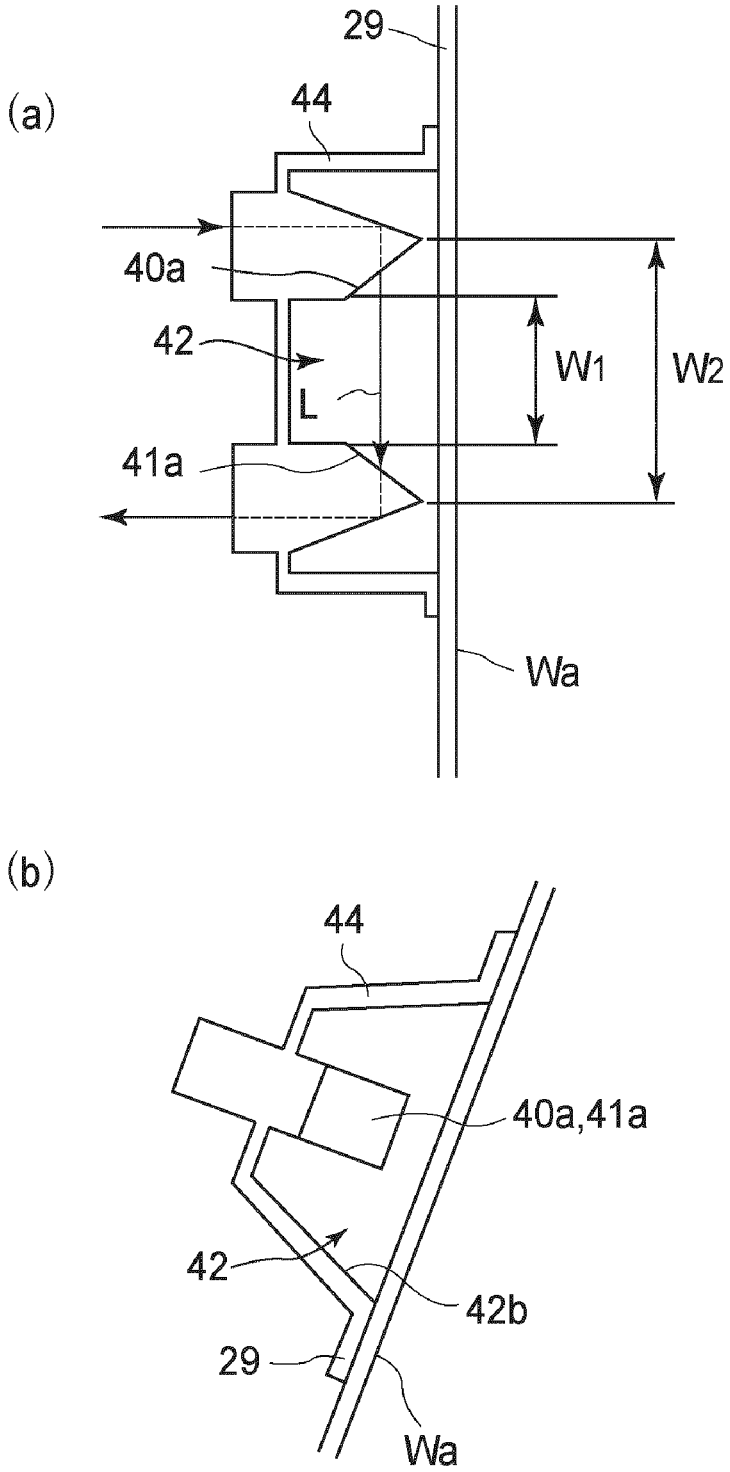
FIG. 19(*a*) is a horizontal sectional view of a transparent member of the light transmission type, which is made up of a pair of transparent portions for detecting the amount of the remaining toner, and FIG. 19(*b*) is a vertical sectional view (at a plane parallel to the front panel of the apparatus) of the transparent member of the light transmission type, which is made up of a pair of transparent portions for detecting the amount of the remaining toner.
Figure 20:
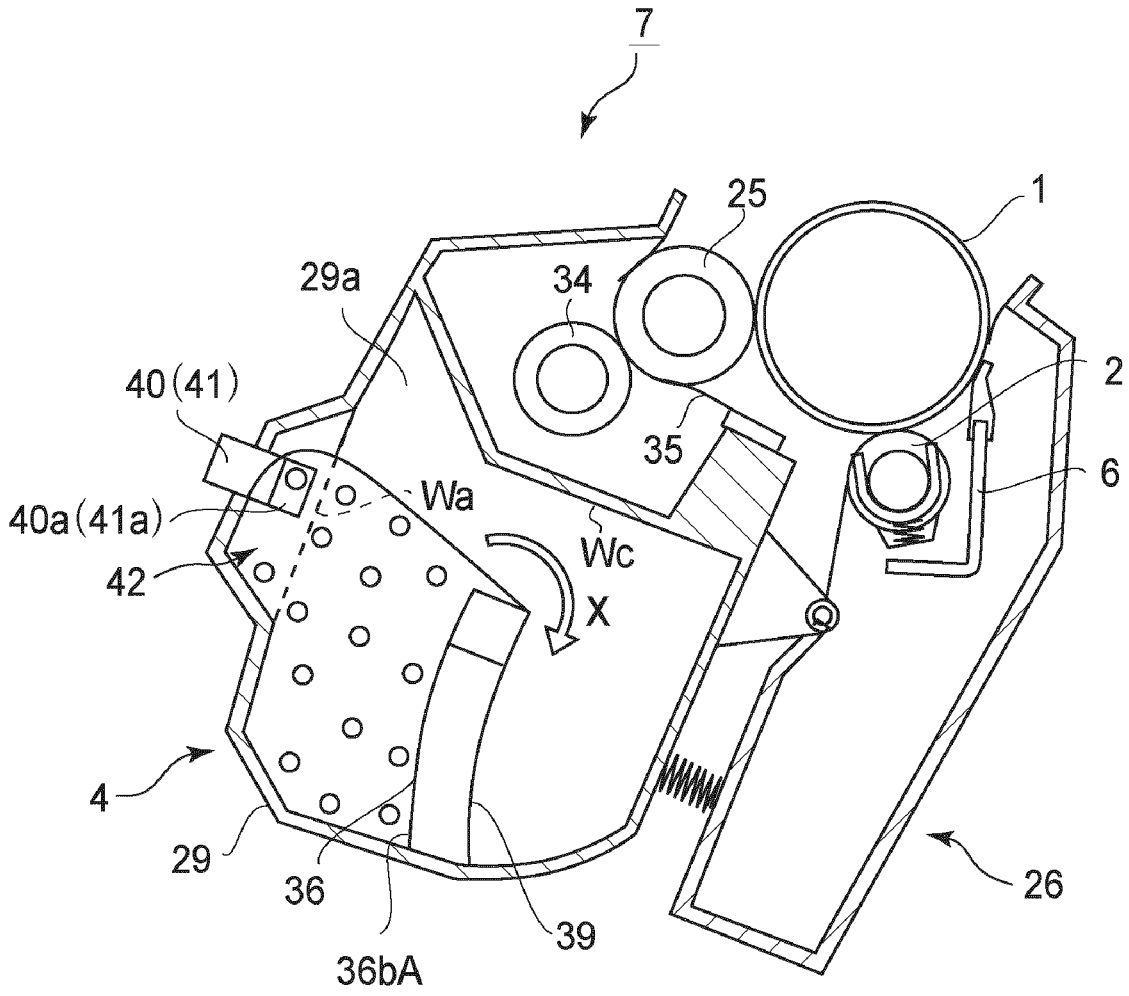
FIG. 20 is a cross-sectional view of the developing apparatus, which is in the state in which its light receiving portion does not receive the remaining toner amount detection light.

Further, referring to FIGS. 14 and 18(*a*), the light exit surface 40*a* and light entrance surface 41*a* for detecting the amount of the remaining toner, based on the amount of light transmission, are positioned so that they oppose each other, in terms of the direction parallel to the rotational axis of the toner stirring member 36. The light exit surface 40*a* is an integral part of the transparent member 40 which guides the detection light $L_{in}$ emitted from the LED (unshown), as a light emitting portion, which is provided with the main assembly 100A of the electrophotographic image forming apparatus, into the recess 42 (that is, toner chamber 29*a*).

The light exit surface 41*a* is an integral part of the transparent member 41, which guides the detection light $L_{out}$ to the phototransistor (unshown), as the light receiving portion, which is provided with the main assembly 100A of the electrophotographic image forming apparatus, after the detection light L is transmitted through the recessed portion 42. Incidentally, the transparent members 40 and 41 may be integrated into a single component.

As the cleaning member 39 rotates, not only do the wiping sheet 39*a* and auxiliary wiping sheet 39*b* of the cleaning member 39 clean the light exit surface 40*a* and light entrance surface 41*a*, but also, they block the detection light L while they are wiping the light exit surface 40*a* and light entrance surface 41*a*.

Figure 16:
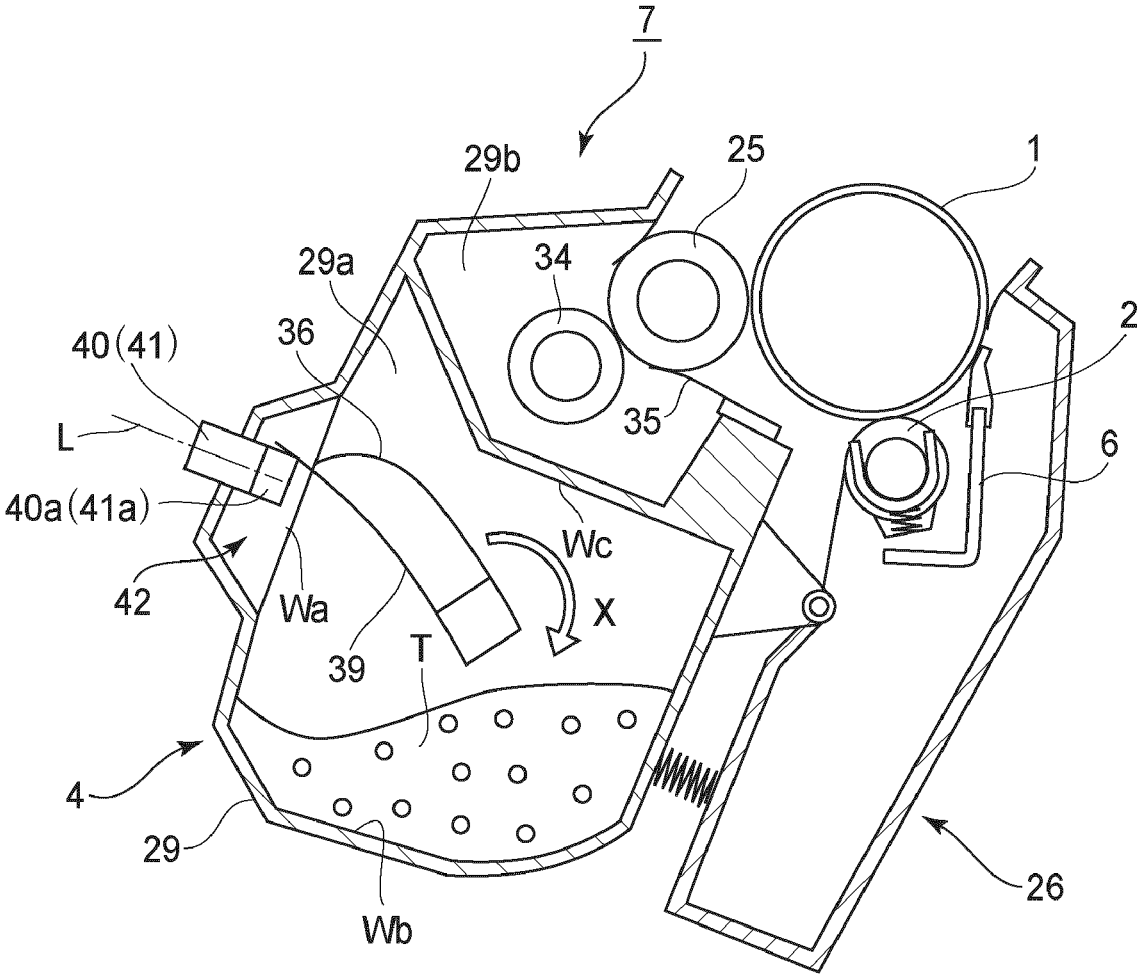
FIG. 16 is a schematic cross-sectional view of the developing apparatus, in the second embodiment, which is in the state in which the toner remainder amount detection light L is received by the light receiving portion.

FIG. 16 is a cross-sectional view of the process cartridge 7 immediately after the cleaning of the light exit surface 40*a* and light entrance surface 41*a*, respectively, by the cleaning member 39. When the process cartridge 7 is in the state shown in FIG. 16, the detection light L is transmitted through the recess 42, and is detected by the light receiving portion in the main assembly of the image forming apparatus, through the light exit surface 41*a*.

Figure 17:
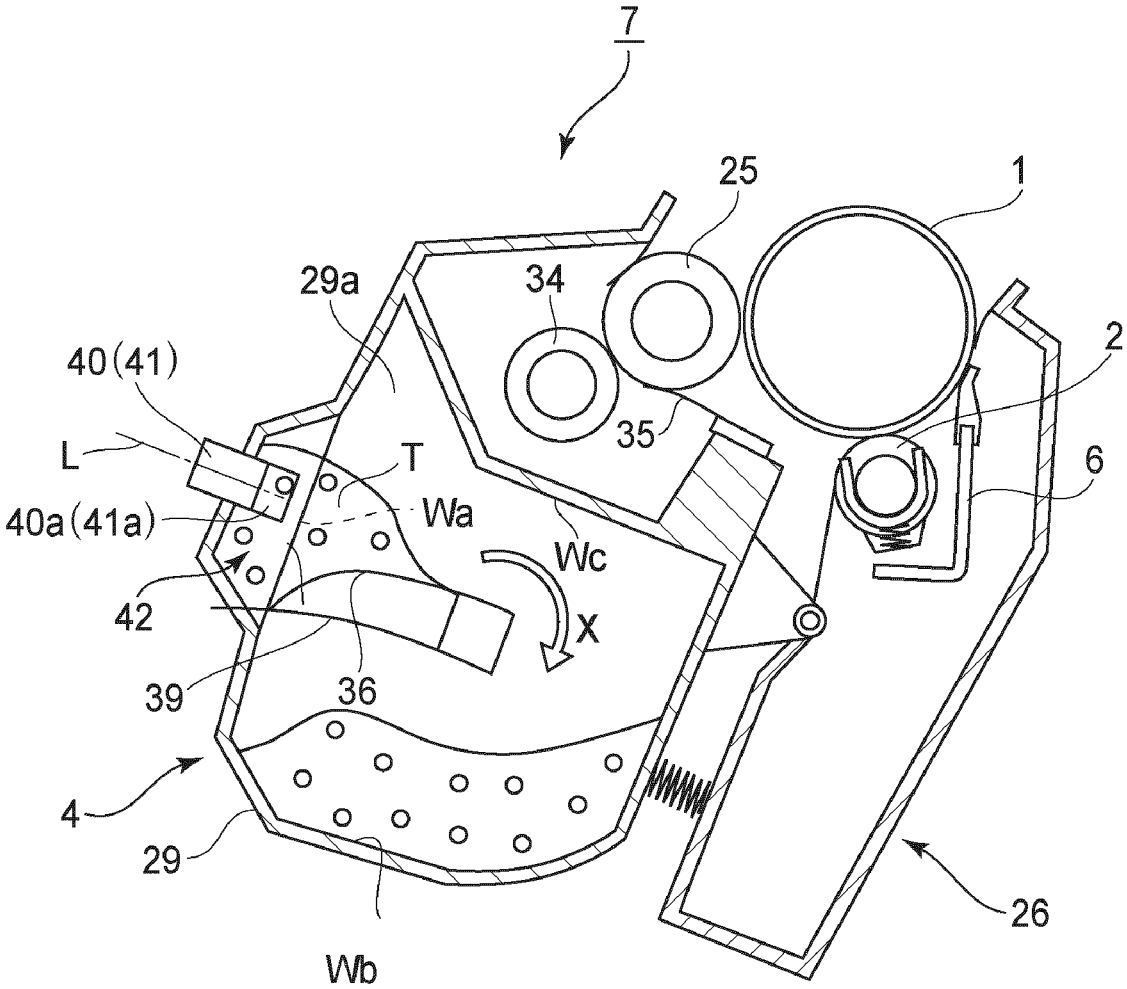
FIG. 17 is a schematic cross-sectional view of the developing apparatus in the second embodiment, which is in the state in which the toner remainder amount detection light L is not received by the light receiving portion.

On the other hand, FIG. 17 is a cross-sectional view of the process cartridge 7 immediately before the light exit surface 40*a* and light entrance surface 41*a*, respectively, are cleaned by the cleaning member 39. When the process cartridge 7 is in the state shown in FIG. 17, the detection light L is blocked in the recess 42 by the body of toner T, which is being conveyed by the toner stirring member 36, and therefore, it does not reach the light exit surface 41*a*. Thus, it is not received by the light receiving portion in the main assembly of the image forming apparatus.

With the employment of the above described structural arrangement, the amount of the toner remaining in the toner chamber 29*a* can be estimated based on the length of time the detection light L is transmitted through the toner chamber 29*a* (that is, recessed portion 42), that is, the length of time the detection light L is received by the light receiving portion of the image forming apparatus, per rotation of the toner stirring member 36.

[Position and Shape of Light Exit Surface and Light Entrance Surface]

At this time, referring to FIGS. 14 and 18, the position and shape of the light exit surface 40*a* and the light entrance surface 41*a* of the pair of transparent members 40 and 41, respectively, will be described in more detail.

In this embodiment, the amount of the remaining toner is detected by the pair of transparent members 40 and 41, based on the light transmission through the transparent members 40 and 41.

That is, referring to FIG. 18, as described above, according to the remaining toner amount detecting means in this embodiment, the detection light $L_{in}$ emitted from the light emitting portion (unshown), such as a LED, attached to the main assembly of the image forming apparatus is guided to the transparent member 40. Entering the transparent member 40, the detection light $L_{in}$ is deflected by 90°, by the reflective surface 40*r* of the transparent member 40, being thereby guided toward the light exit surface 40*a* of the transparent member 40, and exits from the transparent member 40 through the light exit surface 40*a*. Exiting through the light exit surface 40*a*, the detection light L travels through the process cartridge, and is guided into the light entrance surface 41*a* of the transparent member 41, that is, the other transparent member, which opposes the transparent member 40. Entering the transparent member 41, the detection light L is deflected by 90° by the reflective surface 41*r* of the transparent member 41. Then, the detection light L travels through the transparent member 41, and exits from the transparent member 41, that is, exits from the process cartridge. Exiting from the process cartridge, the detection light $L_{out}$ is guided to the light receiving portion, such as a phototransistor, attached to the main assembly of the image forming apparatus.

Referring also to FIG. 18, in this embodiment, the transparent members 40 and 41 are structured and positioned (attached to development unit 4) so that the distance W2 between the inward edges of the mutually opposing light exit surface 40*a* and light entrance surface 41*a* is greater than the outward edges of the mutually opposing light exit surface 40*a* and light entrance surface 41*a* (that is, W2>W1).

Therefore, in order to ensure that the tilted light exit surface 40*a* and the light entrance surface 41*a*, which oppose each other, are satisfactorily cleaned by the wiping sheet 39*a* of the cleaning member 39, the wiping sheet 39*a* is rendered trapezoidal, as described above. Also in order to ensure that the wiping sheet 39*a* of the cleaning member 39 cleans the light exit surface 40*a* and the light entrance surface 41*a* by elastically contacting the surfaces 40*a* and 41*a*, the wiping sheet 39*a* is rendered slightly larger than the trapezoidal area which the mutually opposing light exit surface 40*a* and the light entrance surface 41*a* form as shown in FIG. 18(*a*).

Depending on the positional relationship among the light exit surface 40*a*, the light entrance surface 41*a*, and the toner stirring member 36, the toner on the toner stirring member 36 and the toner on the cleaning member 39 sometimes fall from the toner stirring member 36 and/or the cleaning member 39, respectively, and adheres to the light exit surface 40*a* and light entrance surface 41*a*, immediately after the cleaning of the surfaces 40*a* and 41*a* by the cleaning member 39. Therefore, the detection light L is sometimes blocked by the toner that fell from the stirring member 36 and/or cleaning member 39 immediately after the cleaning. Further, the detection light L is sometimes blocked because the toner particles floating in the toner chamber 29*a* adhere to the light exit surface 40*a* and the light entrance surface 41*a*.

Thus, in this embodiment, in order to prevent the problem that the toner, which fell from the toner stirring member 36 and/or the cleaning member 39, adheres to the light exit surface 40*a* and the light entrance surface 41*a*, the following structural arrangement is employed.

That is, referring to FIG. 14, the transparent members 40 and 41 are attached to the portion Wa of the toner chamber wall, which will be above the horizontal plane H which coincides with the rotational axis O of the stirring member 36 when the process cartridge is in its image forming position in an image forming apparatus. Further, the portion Wa of the wall of the toner chamber 29*a* is tilted so that a straight line Va drawn perpendicularly and inwardly from the portion Wa is on the bottom side of the horizontal plane which coincides with the point of the portion Wa, from which the straight line Va is drawn. Further, referring to FIG. 18, the development unit 4 is structured so that a straight line Vb drawn inward of the toner chamber 29*a* from the light exit surface 40*a* (41*a*), and perpendicularly to the light exit surface 40*a* (41*a*), is under the horizontal plane which coincides with the point of the light exit surface 40*a*, from which the straight line Vb is drawn.

Incidentally, the angle of the top surface of the body of developer in the toner chamber 29*a* is affected by the angle of the axial line of the stirring member during the mounting of the process cartridge. Therefore, in order to reduce the effect of the inclination of the surface of the body of developer in the toner chamber 29*a*, the light exit surface 40*a* and light entrance surface 41*a* are desired to be positioned roughly at the middle of the toner chamber 29*a* in terms of the direction parallel to the axial line of the stirring member 36.

[Improvement in Blocking of Detection Light by Toner]

In this embodiment, the toner chamber 29*a* is provided with the recess 42, which is recessed outward from the toner chamber 29*a* in the radius direction of the sweeping area of the stirring member 36. More specifically, the portion Wa of the wall of the toner chamber 29*a*, which is between the portions Wb and We of the wall of the toner chamber 29*a*, is provided with the recess 42. As will be evident from FIG. 18, the recess 42 is a boxy space which opens to the toner chamber 29*a*, and the opening of which has a size of w1 (length of the edge perpendicular to the axial line of the toner stirring member)×w3 (length of the edge parallel to the axial line of the toner stirring member).

That is, the recess 42 has lateral walls 42*a*1 and 42*a*2 which oppose each other in terms of the direction parallel to the rotational axis of the toner stirring member 36, and walls 42*b*1 and 42*b*2 which oppose each other in terms of the rotational direction of the toner stirring member 36. Further, the recess 42 has the bottom wall which holds a distance h from the plane of the opening 42A of the recess 42, that is, the border between the recess 42 and toner chamber 29*a*, and has a size of w2×w3. In this embodiment, the transparent members 40 and 41 are attached to the bottom wall 42*c* of the recess 42.

Also referring to FIG. 18, in this embodiment, the wall of the recess 42 is an integral part of the portion Wa (tilted portion) of the wall of the toner chamber 29*a* (that is, development means frame 29). However, the wall of the recess 42, and the pair of transparent members 40 and 41 may be integrally formed as a single piece, which is attachable to the portion Wa of the wall of the toner chamber 29*a* (that is, developing means frame 29).

The development unit 4 (recess 42) is structured so that there is a gap g between the most inward edge of the surface 40*a* (41*a*) of the transparent member 40 (41) and the plane of the opening 42A of the recess 42 (FIGS. 18(*b*) and 21). The value of the gap g has only to be such that the transparent members 40 and 41 are prevented from protruding beyond the plane coinciding with the inward surface of the portion Wa of the toner chamber wall. That is, the gap g is to be provided to prevent the problem that the toner stirring member 36 deforms by hanging up on the transparent members 40 and 41. Also in this embodiment, the development unit 4 (recess 42) is structured so that there is a certain amount of distance between the light exit surface 40*a* (and light entrance surface 41*a*) and the bottom wall 42*c*. This structural arrangement is made to prevent the problem that sometimes, the amount of the toner remainder cannot be accurately detected because toner sometimes fails to reach the adjacencies of the bottom wall 42*c*.

Thus, in this embodiment, the above described structural arrangement is employed to ensure that the detection light L remains satisfactorily blocked until the sweeping edge 36*b*A of the stirring sheet 36*b* begins to move through the adjacencies of the light exit surface 40*a* and light entrance surface 41*a*, and also, to better control the toner in its behavior while the sweeping edge 36*b*A of the stiffing sheet 36*b* moves through the adjacencies of the light exit surface 40*a* and light entrance surface 41*a*.

However, regarding the blocking of the detection light L while the sweeping edge 36*b*A of the stiffing sheet 36*b* moves through the adjacencies of the light exit surface 40*a* and the light entrance surface 41*a*, because toner slips through the gap between the sweeping edge 36*b*A of the stirring sheet 36*b* and the portion Wa of the toner chamber wall, which has the recess 42, it is still difficult to keep the detection light L satisfactorily blocked while the sweeping edge 36*b*A of the stirring sheet 36*b* is moving through the abovementioned area.

Figure 21:
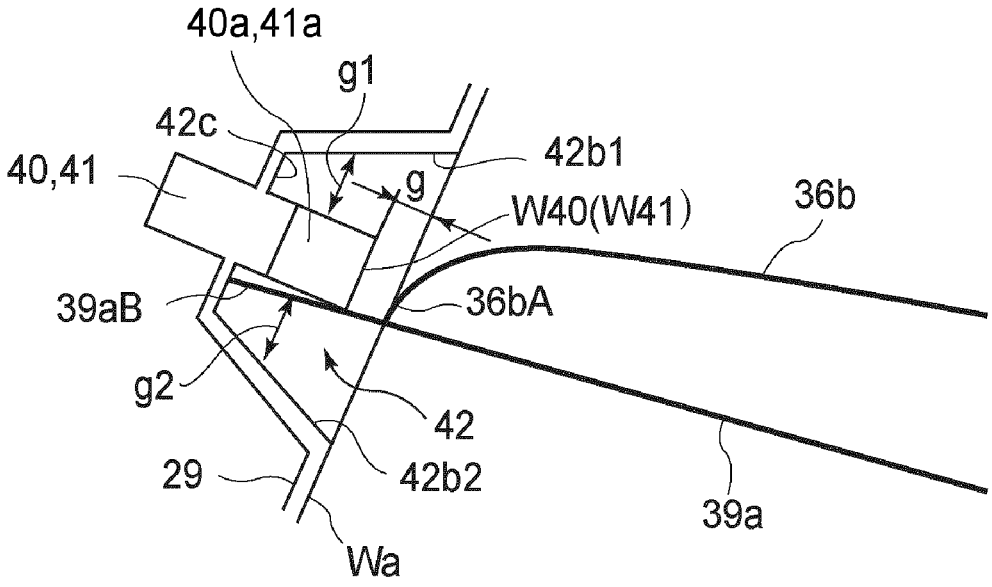
FIG. 21 is a cross-sectional view of the transparent member, its adjacencies, stirring sheet, and wiping sheet of the development unit, showing the relationship between the stirring sheet and wiping sheet when the wiping member begins to clean the transparent member.

More specifically, referring to FIG. 21, while the sweeping edge 36*b*A of the stiffing sheet 36*b* moves through the adjacencies of the light exit surface 40*a* and light entrance surface 41*a*, the wiping sheet 39*a*, which is on the downstream side of the stirring sheet 36*b* in terms of the rotational direction of the toner stirring member 36, enters the space between the light exit surface 40*a* and light entrance surface 41*a*. Further, the development unit 4 (toner chamber 29*a*) is structured so that the wiping sheet 39*a* for cleaning the light exit surface 40*a* and the light entrance surface 41*a* comes into contact with the sweeping edge 36*b*A of the stiffing sheet 36*b* when the wiping sheet 39*a* enters the space between the light exit surface 40*a* and light entrance surface 41*a*. Therefore, while the stirring sheet 36*b* moves through the space between the light exit surface 40*a* and light entrance surface 41*a*, the gap g between the sweeping edge 36*b*A of the stiffing sheet 36*b*, and the portion Wa of the wall of the toner chamber 29*a*, which corresponds to the recess 42, is covered by the wiping sheet 39*a*. Therefore, this embodiment is superior to the first embodiment in terms of keeping the detection light L satisfactorily blocked while the sweeping edge 36*b*A of the stiffing sheet 36*b* move through the adjacencies of the light exit surface 40*a* and light entrance surface 41*a*.

Further, the development unit 4 (toner chamber 29*a*) is structured so that the wiping sheet 39*a* for cleaning the light exit surface 40*a* and the light entrance surface 41*a* comes into contact with the sweeping edge 36*b*A of the stirring sheet 36*b* when the wiping sheet 39*a* enters the space between the light exit surface 40*a* and the light entrance surface 41*a*, and also, so that the wiping sheet 39*a* begins to clean the light exit surface 40*a* and the light entrance surface 41*a* the moment the body of toner T, which is being conveyed by the stirring sheet 36*b*, finishes moving through the space between the light exit surface 40*a* and the light entrance surface 41*a*. Therefore, it is possible to reduce the severity of the problem that because the blockage of the detection light and the transmission of the detection light through the toner chamber (recess) are affected by the variation in the amount of toner that adheres or remains adhered to the light exit surface 40*a* and light exit surface 41*a*, the amount of the toner remaining in the toner chamber cannot be accurately detected.

[Improvement of Wiping Performance of Cleaning Member]

Referring to FIGS. 15, 18, and 21, the pair of the light exit surface 40*a* and the light entrance surface 41*a*, the transparent members 40 and 41, the recess 42, and the cleaning member 39 will be described in more detail regarding their shape.

The cleaning member 39 cleans the light exit surface 40*a* and the light entrance surface 41*a* by being moved through the space between the light exit surface 40*a* and the light entrance surface 41*a*, which are aligned in the direction parallel to the rotational axis of the toner stirring member 36.

The shape of the sheet stirring member 36 and the cleaning member 39, and the recess 42, are as described above with reference to FIGS. 15 and 18.

In order for the wiping sheet 39*a* to satisfactorily wipe clean the light exit surface 40*a* and the light entrance surface 41*a*, the rigidity of the wiping sheet 39*a* in terms of the vertical direction needs to be greater than a certain value. However, if the wiping sheet 39*a* is excessively increased in rigidity, the wiping sheet 39*a* cannot be moved into the space between the light exit surface 40*a* and the light entrance surface 41*a*. Thus, in order to allow the wiping sheet 39*a* to enter the space between the light exit surface 40*a* and the light entrance surface 41*a*, the rigidity of the wiping sheet 39*a* in terms of the direction parallel to the circumferential direction of the sweeping area of the toner stirring member 36 needs to be greater than the rigidity of the wiping member 39*a* in terms of the direction perpendicular to the light exit surface 40*a* and the light entrance surface 41*a*.

Therefore, in this embodiment, in order to add to the rigidity of the wiping sheet 39*a* in terms of the circumferential direction of the sweeping area of the toner stirring member 36, the cleaning member 39 is provided with the auxiliary wiping sheet 39*b*, which is positioned on the downstream side of the wiping sheet 39*a* in terms of the rotational direction of the stirring member.

The width W3 of the edge of the auxiliary wiping sheet 39*b* on the wiping sheet side is less than the width W1*a* of the wiping edge 39*a*B of the wiping sheet 39*a*, which is perpendicular to the light exit surface 40*a* and light entrance surface 41*a* (W3<W1*a*). Further, the auxiliary wiping sheet 39*b* is shaped so that the width W3 is less than the shortest distance W1 between the light exit surface 40*a* and the light entrance surface 41*a* (W3<W1).

Further, referring to FIG. 18, the light exit surface 40*a* and light entrance surface 41*a* are tilted so that their inward edges in terms of the radius direction of the sweeping area of the toner stirring member 36, is longer than their outward edges (W1<W2). Therefore, the wiping sheet 39*a* is shaped so that its inward edge 39*a*C, in terms of the radius direction of the stirring member 36, is longer than its outward edge 39*a*B (W2*a*>W1*a*).

The wiping sheet 39*a* is shaped and sized to ensure that even if the wiping sheet 39*a* deforms and/or creeps, or the like problems occur, it can still wipe clean the light exit surface 40*a* and the light entrance surface 41*a* across their entire range in terms of the circumferential direction of the sweeping area of the toner stirring member 36. That is, the wiping sheet 39*a* is rendered long enough, in terms of the radius direction of the sweeping area of the toner stirring member 36, to enter the portion of the recess 42, which is between the light exit surface 40*a* and the light entrance surface 41*a*, and deep enough to reach the bottom wall 42*c* of the recess 42.

Further, in order to ensure that the wiping sheet 39*a* wipes the light exit surface 40*a* and the light entrance surface 41*a* across their entire range in terms of the rotational direction of the toner stirring member 36, a gap g1, which is the gap between the transparent member 40 (41) and the lateral wall 42*b*1, which is the downstream wall of the recess 42 in terms of the rotational direction of the toner stirring member 36, and a gap g2, which is the gap between the transparent member 40 (41) and the lateral wall 42*b*2, which is the upstream wall of the recess 42 in terms of the rotational direction of the toner stirring member 36, are rendered large enough for the wiping sheet 39*a* to satisfactorily wipe the light exit surface 40*a* and the light entrance surface 41*a* across their entire ranges in terms of the rotational direction of the toner stirring member 36.

[Prevention of Toner Adhesion After Wiping of Light Exit Surface and Light Entrance Surface by Cleaning Member]

Figure 22:
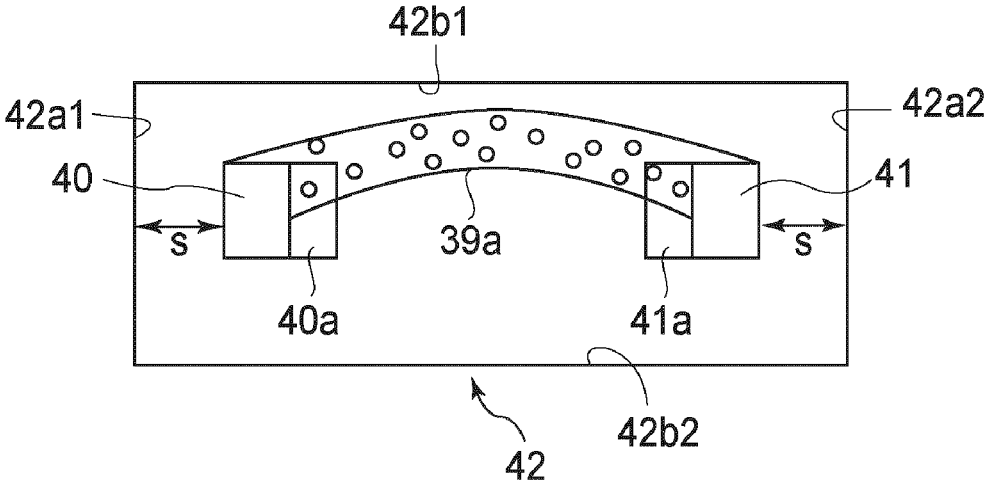
FIG. 22 is a schematic sectional view (at the vertical plane) of the transparent member and wiping sheet of the development unit, in the second embodiment, having a gap between the wall of the recessed portion and transparent member, when the transparent member is being cleaned, showing the developer on the wiping sheet.
Figure 23:
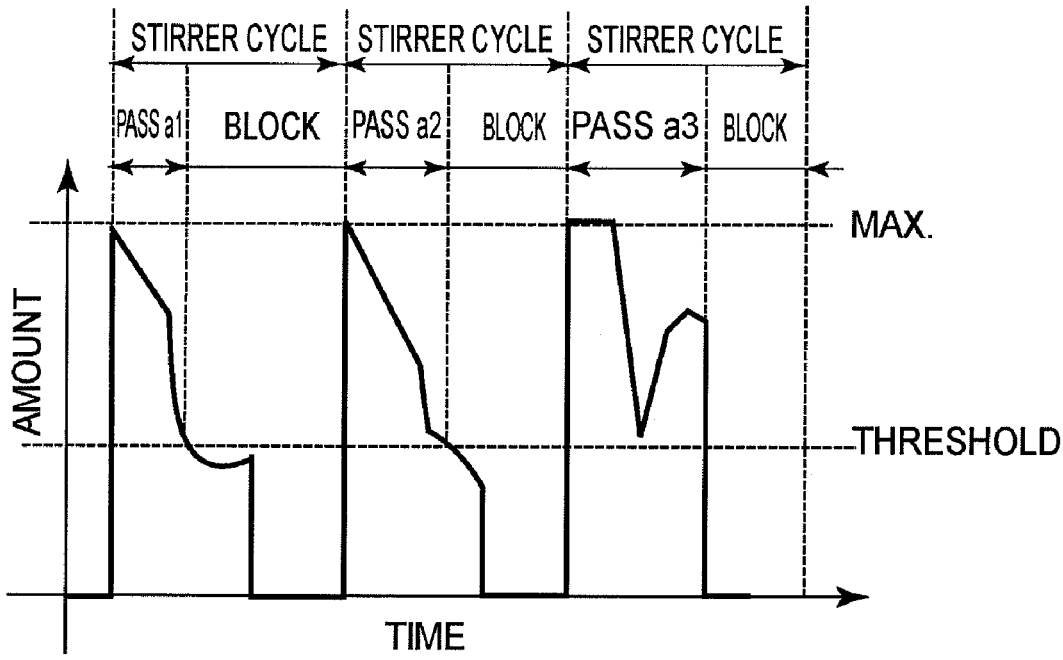
FIG.23 PRIOR ART
FIG. 23 is a graph showing the changes (waveform) in the relationship between the amount of the remaining developer amount detection light received by the light receiving portion of the image forming apparatus in accordance with the prior art, and the elapsed time.

Referring to FIG. 22, while the wiping sheet 39*a* moves between the light exit surface 40*a* and the light entrance surface 41*a*, it is kept deformed by the light exit surface 40*a* and the light entrance surface 41*a*, and there is toner T on the wiping sheet 39*a*.

As soon as the wiping sheet 39*a* moves past the space between the light exit surface 40*a* and the light entrance surface 41*a*, the wiping sheet 39*a* is freed from the restriction placed on the wiping sheet 39*a* by the light exit surface 40*a* and the light entrance surface 41*a*, and therefore, it springs back into its normal shape because of its resiliency. As a result, the toner T on the wiping sheet 39*a* is catapulted downward in terms of the rotational direction of the toner stirring member 36, in the recess 42.

Figure 27:
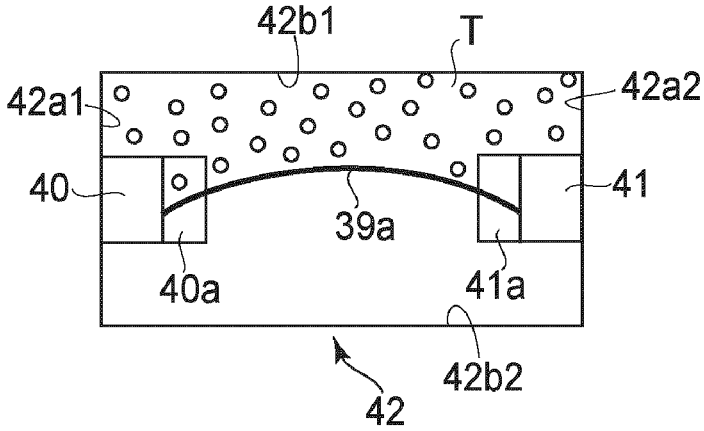
FIG. 27 is a schematic sectional view (at the vertical plane) of the transparent member and wiping sheet of the development unit, in a comparative embodiment, having no gap between the wall of the recessed portion and transparent member, when the transparent member is being cleaned, showing the developer on the wiping sheet.

If there is no space between the lateral wall 42*a*1 and the transparent member 40, and between the lateral wall 42*a*2 and the transparent member 41 (FIG. 27), the toner T on the wiping sheet 39*a* falls through the space between the light exit surface 40*a* and the light entrance surface 41*a* after the cleaning of the light exit surface 40*a* and the light entrance surface 41*a*. As the toner T falls, it sometimes adheres again to the light exit surface 40*a* and light entrance surface 41*a*.

Thus, in this embodiment, in order to prevent the problem that after the toner T is wiped away from the light exit surface 40*a* and the light entrance surface 41*a*, it adheres again to the light exit surface 40*a* and the light entrance surface 41*a*, a space S is provided between the transparent members 40 and 41, and lateral walls 42*a*1 and 42*a*2, respectively, of the recess 42, as shown in FIG. 22. With the provision of the space S between the transparent members 40 and 41, and the lateral walls 42*a*1 and 42*a*2, respectively, of the recess 42, the toner borne on the wiping sheet 39*a* while the wiping sheet 39*a* moves between the light exit surface 40*a* and light entrance surface 41*a* falls through the gaps S between the transparent members 40 and 41, and lateral walls 42*a*1 and 42*a*2, respectively, of the recess 42. Therefore, when the wiping sheet 39*a* moves out of the space between the light exit surface 40*a* and the light entrance surface 41*a*, there remains only a small amount of toner on the wiping sheet 39*a*.

The severity of the problem that the amount of the remaining toner in the toner chamber 29*a* is inaccurately detected because of the variation in the amount of the toner which adheres again to the light exit surface 40*a* and the light entrance surface 41*a* after the light exit surface 40*a* and light entrance surface 41*a* are cleaned, can be reduced by reducing the amount of toner T that remains on the wiping sheet 39*a* when the wiping sheet 39*a* moves out of the space between the light exit surface 40*a* and the light entrance surface 41*a*, that is, when the wiping sheet 39*a* that is kept deformed while moving between the light exit surface 40*a* and the light entrance surface 41*a* is allowed to spring back into its normal shape.

Further, if the body of toner T, which entered the recess 42 during the period in which the detection light L was blocked, remains in the recess 42 even after the passage of the cleaning member 39 through the space between the light exit surface 40*a* and the light entrance surface 41*a*, the toner sometimes adheres to the light exit surface 40*a* and the light entrance surface 41*a*, and therefore, blocks the detection light L, after the cleaning of the light exit surface 40*a* and the light entrance surface 41*a*.

The lateral wall 42*b*2 of the recess 42, that is, the lateral wall of the recess 42, which is on the bottom side, and on the upstream side in terms of the rotational direction of the toner stirring member 36 (FIG. 18), is tilted by the angle of θ, the value of which is large enough to cause the toner T to fall into the toner chamber 29*a*. This structural arrangement is for preventing the toner T from remaining in the recess 42 after the cleaning member 39 moves between the light exit surface 40*a* and the light entrance surface 41*a*.

As described above, not only can this embodiment offer the same effects as the first embodiment, but also, can prevent the problem that during the period in which the detection light L is to be allowed to be transmitted through the space between the light exit surface 40*a* and the light entrance surface 41*a*, the toner adheres to the light exit surface 40*a* and the light entrance surface 41*a* immediately after the cleaning of the light exit surface 40*a* and the light entrance surface 41*a*. On the other hand, the toner in the toner chamber 29*a* is moved into the light passage L by the stiffing member 36 to block the detection light L. Therefore, the length of time the detection light L remains blocked is not affected by the change in the fluidity of the toner. Further, the light exit surface 40*a* and the light entrance surface 41*a* are more efficiently wiped clean by the cleaning member 39.

In the foregoing examples, the use has been made with a remaining toner amount detecting means of the light transmission type, but the present invention is not limited to the toner remainder amount detecting means of this type, and those utilizing electrostatic capacity is usable.

According to the present invention, the developer detecting member is attached to the portion of the developer storage chamber wall, along which the developer stiffing member conveys upward the developer in the developer storage chamber into the development chamber located on top of the developer storage chamber. Therefore, the amount of the developer remaining in the developer storage chamber can be detected while the body of developer is stable. Therefore, the amount of the remaining developer can be more precisely detected. Further, the remaining developer amount detecting method based on the amount of light transmission is employed. Therefore, the amount of the remaining developer can be detected with the use of a small number of components which are inexpensive. Therefore, it is possible to provide a developing apparatus, a process cartridge, and an electrophotographic image forming apparatus, which are significantly lower in cost than those in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 022466/2007 and 291356/2007 filed Jan. 31, 2007 and Nov. 8, 2007, respectively which are hereby incorporated by reference.

What is claimed is:

1. A developing apparatus for use with an electrophotographic image forming apparatus, said developing apparatus comprising:

a developer accommodating chamber that accommodates a developer;

a developer chamber including a developer carrying member that carries and feeds a developer supplied from said developer accommodating chamber to develop an electrostatic latent image formed on an electrophotographic photosensitive member;

a developer stirring member, rotatable about a rotation axis in said developer accommodating chamber, that stirs the developer in said developer accommodating chamber, and then supplies the developer from said developer accommodating chamber into said developer chamber through an opening formed in an upper part of said developer accommodating chamber when said developing apparatus is mounted on the electrophotographic image forming apparatus;

a wall surface, provided in said developer accommodating chamber, contactable by a free end portion of said developer stirring member while said developer stifling member is moving, wherein said developer stirring member lifts the developer toward said opening along said wall surface in said developer accommodating chamber; and a light emergent portion that permits light for detecting a remaining amount of the developer in said developer accommodating chamber to emerge therefrom into said developer accommodating chamber; and an incident portion that receives the detecting light that emerged from said light emergent portion, wherein, when said developing apparatus is mounted on the electrophotographic image forming apparatus, a position where the free end portion of said developer stirring member separates from said wall surface is (i) above said light emergent portion and said incident portion in a vertical direction, and (ii) is closer to the rotation axis of said developer stirring member in a horizontal direction than said light emergent portion and said incident portion as seen along the rotation axis.

2. An apparatus according to claim 1, wherein said developer detector is disposed above the rotation axis of said developer stifling member.

3. An apparatus according to claim 1, wherein said developer stifling member includes a shaft member, and a flexible sheet having one end mounted in said shaft member and the other end contactable to said wall surface.

4. An apparatus according to claim 1, wherein said light emergent portion and said incident portion are provided in a recess provided in said wall surface.

5. An apparatus according to claim 4, wherein said light emergent portion and said incident portion are provided at positions away from a bottom surface of said recess and not beyond said wall surface.

6. An apparatus according to claim 1, wherein a developer detector includes said light emergent portion that outputs a detection beam into said developer accommodating chamber and said incident portion that receives the detection beam, and said developer detector detects the remaining amount of the developer in said developer accommodating chamber on the basis of the length of time the detection beam is blocked by the developer.

7. A process cartridge detachably mountable to a main assembly of an electrophotographic image forming apparatus, said process cartridge comprising:

an electrophotographic photosensitive member on which an electrostatic latent image is formed;

a developer accommodating chamber that accommodates a developer;

a developer chamber including a developer carrying member that carries and feeds a developer supplied from said developer accommodating chamber to develop said electrostatic latent image formed on said electrophotographic photosensitive member;

a developer stirring member, rotatable about a rotation axis in said developer accommodating chamber, that stirs the developer in said developer accommodating chamber, and then supplies the developer from said developer accommodating chamber into said developer chamber through an opening formed in an upper part of said developer accommodating chamber, when said process cartridge is mounted on the electrophotographic image forming apparatus;

a wall surface, provided in said developer accommodating chamber, contactable by a free end portion of said developer stirring member while said developer stifling member is moving, wherein said developer stirring member lifts the developer toward said opening along said wall surface in said developer accommodating chamber; and a light emergent portion that permits light for detecting a remaining amount of the developer in said developer accommodating chamber to emerge therefrom into said developer accommodating chamber; and an incident portion that receives the detecting light that emerged from said light emergent portion, wherein, when said process cartridge is mounted on the electrophotographic image forming apparatus, a position where the free end portion of said developer stirring member separates from said wall surface is (i) above said light emergent portion and said incident portion in a vertical direction, and (ii) is closer to the rotation axis of said developer stirring member in a horizontal direction than said light emergent portion and said incident portion as seen along the rotation axis.

8. A process cartridge according to claim 7, wherein said developer detector is disposed above the rotation axis of said developer stifling member.

9. A process cartridge according to claim 7, wherein said developer stirring member includes a shaft member, and a flexible sheet having one end mounted in said shaft member and the other end contactable to said wall surface.

10. A process cartridge according to claim 9, wherein said developer detector is provided in a recess provided in said wall surface.

11. A process cartridge according to claim 10, wherein said light emergent portion and said incident portion are provided at positions away from a bottom surface of said recess and not beyond said wall surface.

12. An apparatus according to claim 7, wherein a developer detector includes said light emergent portion that outputs a detection beam into said developer accommodating chamber and said incident portion that receives the detection beam, and said developer detector detects the remaining amount of the developer in said developer accommodating chamber on the basis of the length of time the detection beam is blocked by the developer.

13. An electrophotographic image forming apparatus for forming an image on a recording material, said apparatus comprising:

(i) a developing device including, a developer accommodating chamber that accommodates a developer, a developer chamber including a developer carrying member that carries and feeds a developer supplied from said developer accommodating chamber to develop an electrostatic latent image formed on an electrophotographic photosensitive member, a developer stirring member, rotatable about a rotation axis in said developer accommodating chamber, that stirs the developer in said developer accommodating chamber, and then supplies the developer from said developer accommodating chamber into said developer chamber through an opening formed in an upper part of said developer accommodating chamber when said developing device is mounted on said electrophotographic image forming apparatus, a wall surface, provided in said developer accommodating chamber, contactable by a free end portion of said developer stirring member while said developer stirring member is moving, wherein said developer stifling member lifts the developer toward said opening along said wall surface in said developer accommodating chamber, a light emergent portion that permits light for detecting a remaining amount of the developer in said developer accommodating chamber to emerge therefrom in said developer accommodating chamber; and an incident portion that receives the detecting light that emerged from said light emergent portion, wherein, when said developing device is mounted on said electrophotographic image forming apparatus, a position where the free end portion of said developer stifling member separates from said wall surface is (i) above said light emergent portion and said incident portion in a vertical direction, and (ii) is closer to the rotation axis of said developer stirring member in a horizontal direction than said light emergent portion and said incident portion as seen along the rotation axis; and (ii) feeding means for feeding the recording material.

14. An apparatus according to claim 13, wherein a developer detector includes said light emergent portion that outputs a detection beam into said developer accommodating chamber and said incident portion that receives the detection beam, and said developer detector detects the remaining amount of the developer in said developer accommodating chamber on the basis of the length of time the detection beam is blocked by the developer.

15. An electrophotographic image forming apparatus for forming an image on a recording material, said apparatus comprising:

(i) a process cartridge detachably mountable to said electrophotographic image forming apparatus, said process cartridge including, an electrophotographic photosensitive member on which an electrostatic latent image is formed, a developer accommodating chamber that accommodates a developer, a developer chamber including a developer carrying member that carries and feeds a developer supplied from said developer accommodating chamber to develop said electrostatic latent image formed on said electrophotographic photosensitive member, a developer stirring member, rotatable about a rotation axis in said developer accommodating chamber, that stirs the developer in said developer accommodating chamber, and then supplies the developer from said developer accommodating chamber into said developer chamber through an opening formed in an upper part of said developer accommodating chamber, when said process cartridge is mounted on said electrophotographic image forming apparatus, a wall surface, provided in said developer accommodating chamber contactable by a free end portion of said developer stirring member while said developer stirring member is moving, wherein said developer stifling member lifts the developer toward said opening along said wall surface in said developer accommodating chamber, and a light emergent portion that permits light for detecting a remaining amount of the developer in said developer accommodating chamber to emerge therefrom into said developer accommodating chamber; and an incident portion that receives the detecting light that emerged from said light emergent portion, wherein, when said developing apparatus is mounted on said electrophotographic image forming apparatus, a position where the free end portion of said developer stifling member separates from said wall surface is (i) above said light emergent portion and said incident portion in a vertical direction, and (ii) is closer to the rotation axis of said developer stirring member in a horizontal direction than said light emergent portion and said incident portion as seen along the rotation axis;

(ii) mounting means for detachably mounting said process cartridge; and (iii) feeding means for feeding the recording material.

16. An apparatus according to claim 15, wherein a developer detector includes said light emergent portion that outputs a detection beam into said developer accommodating chamber and said incident portion that receives the detection beam, and said developer detector detects the remaining amount of the developer in said developer accommodating chamber on the basis of the length of time the detection beam is blocked by the developer.

* * * * *